United States Patent [19]

Kobayashi et al.

[11] Patent Number: 5,067,419

[45] Date of Patent: Nov. 26, 1991

[54] LOW NOX BOILER

[75] Inventors: Hironobu Kobayashi, Katsuta; Shigeru Azuhata, Hitachi; Kiyoshi Narato; Kenichi Sohma, both of Ibaraki; Yasuo Yoshii, Katsuta; Norio Arashi, Hitachi; Shigekazu Nishimoto; Isao Koyama, both of Yokohama; Tooru Inata, Hitachi; Hideo Kikuchi, Hitachi; Tadayoshi Murakami, Hitachi; Masayuki Taniguchi, Katsuta; Hiroshi Miyadera, Hitachi; Fumio Koda, Kure; Tatsuzou Enomoto, Kure; Kenshi Kobayashi, Kure, all of Japan

[73] Assignees: Hitachi, Ltd.; Hitachi Babcock Kabushiki-kaisha, both of Tokyo, Japan

[21] Appl. No.: 456,561

[22] Filed: Dec. 26, 1989

[30] Foreign Application Priority Data

Dec. 26, 1988 [JP] Japan ..... 63-325847

[51] Int. Cl.[5] ..... F23M 3/02; F23C 7/00; F23D 14/02; F23R 3/18

[52] U.S. Cl. ..... 110/234; 110/210; 431/8; 431/278; 431/284

[58] Field of Search ..... 110/210, 211, 212, 213, 110/214, 234, 262; 60/748, 749; 431/278, 284, 285, 8

[56] References Cited

U.S. PATENT DOCUMENTS

| | | | |
|---|---|---|---|
| 3,894,834 | 7/1975 | Estes | 431/284 X |
| 3,940,253 | 2/1976 | Zetterström | 431/284 X |
| 4,368,677 | 1/1983 | Kline | 110/212 |
| 4,807,541 | 2/1989 | Masai et al. | 431/284 X |
| 4,925,387 | 5/1990 | Locanetto et al. | 431/284 X |
| 4,951,579 | 8/1990 | Bell | 110/212 |

*Primary Examiner*—Henry A. Bennet
*Assistant Examiner*—Christopher B. Kilner
*Attorney, Agent, or Firm*—Antonelli, Terry, Stout & Kraus

[57] ABSTRACT

A low-NOx boiler comprises a burner for burning gaseous fuel, heat transfer pipes heating water by combustion heat of the burner to generate steam and having a passage through which water flows, a steam drum communicating with the heat transfer pipe and accumulating the steam from the heat transfer pipe, and an exhaust gas duct located in the furnace to exhaust combustion gas generated by combustion of gaseous fuel outside of the boiler. The boiler further comprises unburnt gas burner in the exhaust gas duct for burning unburnt content in the combustion gas flowing in the duct. The unburnt gas burner includes a nozzle for injecting premixture flow of fuel and combustion air and flame holding plate located near the downstream side of the outlet of the nozzle to interrupt the premixture flow to form a circulating flow on downstream side of the flame holding plate. As gaseous fuel and air are mixed in advance and a flame is formed, the flame length can be shortened. Furthermore, the flame holding plate enables to reduce NOx generated. Unburnt gas burner provided in the exhaust gas duct makes it possible to notably reduce the concentration of NOx discharged to the outside of the system.

7 Claims, 15 Drawing Sheets

LOW NOX BOILER

BACKGROUND OF THE INVENTION

1. Field of the invention

This invention relates to a boiler which uses a gaseous fuel and, more particularly, to a boiler suitable for reducing the concentration of nitrogen oxides (NOx) exhausted therefrom when the fuel is combusted.

2. Description of the Related Art

The emission control of NOx which causes photochemical smog becomes more severe each year, and the development of technologies for NOx reduction is actively pursued. The fuel for boilers, which produces less pollutants during combustion, is liquefied natural gas (LNG) and so on. The NOx which is produced when a gaseous fuel with less nitrogen contents is combusted is thermal NOx produced by the oxidation Of nitrogen in the air supplied for combustion in a high-temperature atmosphere. The generation of thermal NOx highly depends on the temperature, and the thermal NOx increases as the flame temperature increases. The flame temperature varies according to the mixing ratio of fuel to combustion air, i.e. the excess air ratio (air quantity/-theoretical air quantity), and is highest when the fuel is combusted with an adequate quantity of air (theoretical air quantity), neither excessive nor insufficient, for complete combustion.

In an ordinary gaseous fuel boiler, diffusion combustion is usually performed. In this combustion method, fuel and combustion air are fed through separate nozzles into the furnace and are mixed therein to form a flame thereby providing for flame stability. In this combustion method, however, during the fuel-air mixing process, there invariably exists a zone where the excess air ratio approaches 1 resulting in the flame temperature increasing thereby generating impermissible levels NOx.

The lean combustion, two-stage combustion, and gas recirculation combustion methods have been developed for reducing the amount of NOx by decreasing the flame temperature. The two-stage combustion and the gas recirculation combustion methods are excellent in NOx reduction, but are susceptible to discharging uncombusted gases. In order to prevent this, the furnace has to be large in size, and therefore, these methods are disadvantageous from an economical point of view. The lean combustion is a combustion under a higher excess air ratio. In this method, since the excess air increases, the heat discharged out of the boiler through the combustion gas increases thereby adversely affecting the thermal efficiency of the boiler.

A boiler which employs a premixture flame is disclosed, for example, in Japanese Patent Examined Publication No. 52-26251, which uses a two-stage burning combining a diffusion flame with insufficient air and a premixture flame with excess air. This combustion method is very effective in reducing NOx, but the diffusion flame with an excess air ratio of less than 1 has a long flame form, so that the furnace has to be large. In order to combust uncombusted combustible gases discharged from the air-insufficient diffusion flame, the oxygen in the combustion gas combusted with excess air must be used. To this and, it is necessary to provide sufficient mixing time, so that the boiler has to large. Even when a short premixture flame is employed to enable a compact boiler structure, if combustion is effected under a high excess air ratio, a decrease in boiler efficiency is caused.

SUMMARY OF THE INVENTION

Object of the Invention

An object of this invention is to provide a boiler capable of reducing a quantity of NOx in exhaust gas without increasing the boiler size, and preferably, even decreasing the boiler size.

Yet another object of the present invention resides to providing a boiler which is capable of reducing a quantity of NOx even if combustion is executed with an excess air ratio of about 1.0.

STATEMENT OF THE INVENTION

A boiler according to this invention includes a heat transfer pipe in a furnace for heating water to produce steam due to combustion heat of a gaseous fuel burner means, a steam drum communicating with the heat transfer pipe for accumulating steam supplied therefrom, an exhaust gas duct through which combustion gas is exhausted, and means provided in the exhaust gas duct for combusting uncombusted gaseous fuel.

The gaseous fuel burner means includes a nozzle for injecting a premixture of a gaseous fuel and air into a furnace, and flame holding means near an outlet of the nozzle to divide the premixture into two flows and generate a circulating flow between the two flows.

The premixture burner with flame holding means can stabilize the flame and restrain the generation of NOx. Even if uncombusted gas remains, it is combusted as it flows through the exhaust gas duct, so that a reduction of NOx can be attained for the boiler as a whole.

The flame of the premixture burner is shorter than the diffusion flame, and therefore, the boiler need not be large in size.

The nozzle for injecting a premixture of gaseous fuel and air into the furnace-preferably has a fuel passage, a combustion air passage, and rectifying means disposed in a region where the fuel and air passages converge into a single passage and in a region where the fuel and air are mixed to form a single mixture flow. The fuel-air mixture is preferably fed in a straight-line flow into the furnace.

The flame holding means is preferably a plate provided not parallel to a flow direction of the mainstream of the fuel-air mixture.

It is highly desirable that the gaseous fuel burner means includes a diffusion flame burner having nozzle from which gaseous fuel and air are respectively injected, and premixture flame burners which inject fuel-air mixture, so that when the boiler is started up, a diffusion flame is formed and, as the boiler load increases, the premixture flame burners inject the premixture.

Further, the flame holding means is preferably a plate having an area smaller than a cross sectional area of the nozzle, with the plate being disposed at an outlet of the nozzle not parallel to a flow direction of the mainstream of the mixture. The flame holding means ensures that combustion of the mixture starts at a central portion of the flow of the mixture and that a part of the combustion gas is mixed in the mixture at the outer periphery of the mixture flow before combustion of the mixture starts.

According to the present invention, a suitable gaseous fuel burner preferably has a nozzle for injecting premixture into a furnace in a straight flow, which is obtained by mixing fuel with air in advance of feeding the air and fuel into the furnace. The burner also has a plate having an area smaller than the nozzle cross-sectional area, provided at the outlet of the nozzle not parallel to the flow direction of the mainstream of the mixture, whereby the mixture starts to combust from the central portion of the mixture flow and a part of the combustion gas is mixed in the mixture at the outer periphery of the mixture flow before the mixture starts to combust. The burner further has a diffusion combustion burner for injecting fuel and air through the respective nozzles.

By making a space, in which the combustion gas can circulate larger than the diameter of the fuel-air mixture flow, the combustion gas from the outer periphery of the mixture can be mixed in the mixture before the mixture combusts at the end of the mixture.

According to this invention, the burner for gaseous fuel can be provided with a primary nozzle for injecting gaseous fuel-air mixture, a primary combustion chamber outer wall in a cylindrical or conical form provided on a portion of the primary nozzle close to the furnace to define a primary combustion chamber therein, and a secondary nozzle for injecting combustion air, provided concentric with the primary combustion chamber outer wall.

Preferably, the air ratio of the premixture from the primary nozzle is in a range of 0.5 to 0.9 and the air ratio of the premixture from the secondary nozzle is in a range of 1.0 to 1.5, with the total air ratio of the primary and secondary nozzle being in a range of 1.0 to 1.2.

In order to improve the boiler efficiency, it is important to combust the fuel with a quantity of air close to the theoretical air quantity, whereby the quantity of heat discharged to the outside of the boiler system is reduced, and the furnace has a reduced size thereby decreasing the radiant heat. To this end, a premixture flame is employed which can shorten a length of flame thereof to reduce the furnace size. It is customary that, in order to reduce NOx, the premixture combustion must be carried out under a condition of excess air. However, in accordance with the present invention, it has been experimentally determined that NOx can be reduced by introducing a high-temperature combustion gas to the center portion of the fuel-air mixture and mixing part of the combustion gas with the mixture before the mixture burns. The combustion gas introduced to the center of the mixture ignites the mixture due to heat transfer, thereby stabilizing the flame. By an ignition method such as this, the flame spreads from the center portion of the mixture to the outside thereof. In addition, the combustion gas is mixed in the mixture at the outer periphery thereof and the high-temperature range of the flame is restricted, so that the production of thermal NOx is restrained.

In order to realize this combustion method, a flame holder is disposed not parallel to the direction of the mainstream of the fuel-air mixture such that the mixture collides with the flame holder, thereby generating a circulating flow of high-temperature combustion gas at a downstream side of the flame holder.

To facilitate the mixing of the combustion gas from the outer periphery of the mixture flow with the mixture, a combustion is effected which can circulate the combustion gas near the outlet of the mixture nozzle. To this end, it is desirable to provide a space to which the mixture is injected, with the space being larger in diameter than a diameter of the fuel-air mixture flow.

A similar technology is disclosed, for example, in U.S. Pat. No. 4,150,539, wherein a gas turbine combustor includes a flame holder disposed in a center of the mixture flow; however, no relationship between the diameters of the mixture nozzle and the combustor is described. In a combustion method of a gas turbine disclosed, for example, in U.S. Pat. No. 3,961,475, the mixture is injected radially, and then accumulates near the wall of the combustor. Therefore, the flame is formed from the combustor wall, resulting in an insufficient introduction of the combustion gas from the outside of the mixture flow.

The premixture flame is generally unstable and has a narrow range of stable combustion compared with the diffusion flame. In a boiler in which the load varies frequently, it is necessary to change the quantities of combustion air and fuel to be supplied as quickly as possible. In such a case, the flame tends to be unstable. To prevent this, it is desirable to form a diffusion flame when the load is small, thereby ensuring stabilization of the premixture flame.

When a premixture flame is adopted and a single burner is provided, it is preferable to provide a primary combustion chamber in the burner to realize a low NOx combustion under high load. In the primary combustion chamber, the combustion is effected with a low air ratio as low as 0.5 to 0.9 and then the uncombusted gas therefrom can be completely combusted by the remaining oxygen injected from the secondary nozzle.

DETAILED DESCRIPTION OF THE PREFERRED EMBODIMENTS

Figure 1:
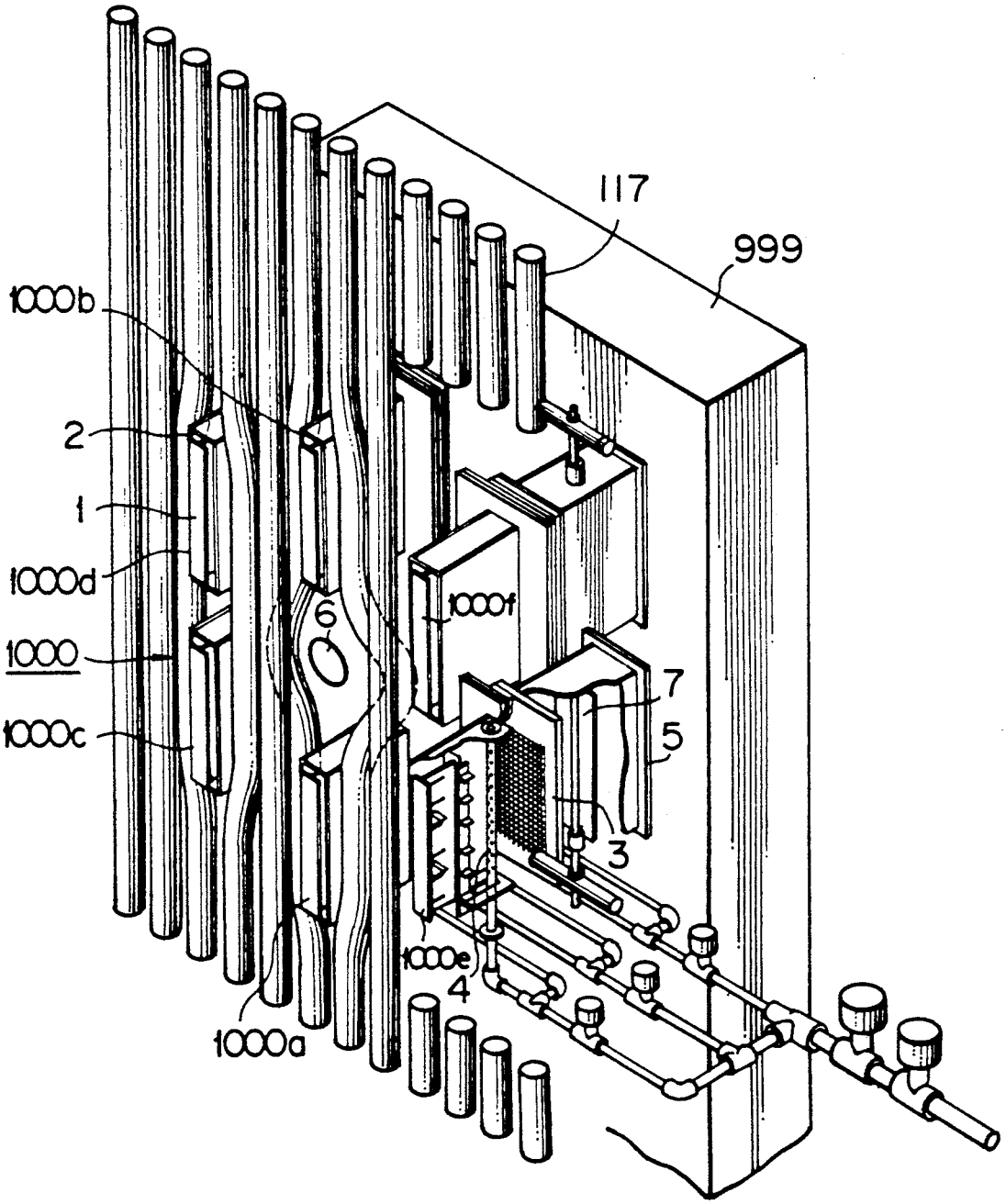
FIG. 1 is a schematic perspective view of a burner 15 for a low-NOx boiler according to an embodiment of the invention.
Figure 2:
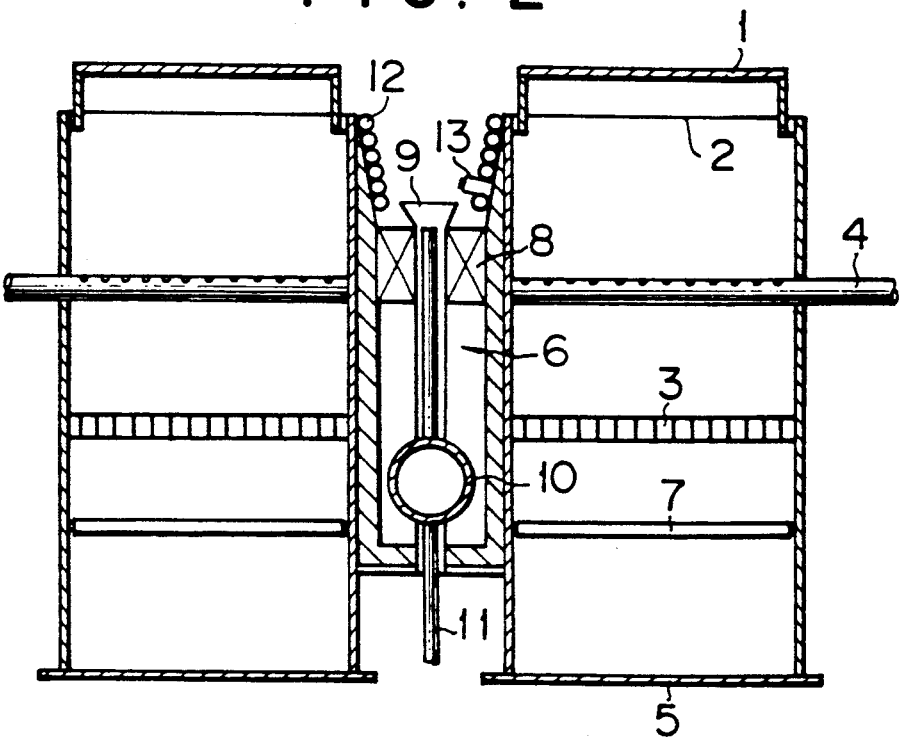
FIG. 2 is a schematic partial cross-sectional view of a portion of the burner in FIG. 1.

Referring now to the drawings wherein the like reference numerals are used throughout the various views to designate like parts and, more particularly, to FIGS. 1 and 2, according to these figures, a burner comprises a cylindrical diffusion flame burner 6 disposed in a central portion and a plurality of premixture flame burner apparatus 1000 disposed around the diffusion flame burner 6. The diffusion flame burner 6 has a fuel nozzle 11 disposed in a center thereof and air nozzles 10 disposed around the fuel nozzle 11. A plurality of heat transfer tubes 117 are disposed adjacent to a furnace wall 999. An ignitor 13 and water pipes 12 for prevention of burning loss of the burner are provided in a throat of the burner. In FIG. 1, the premixture flag burner apparatus 1000 comprises six rectangular burners 1000*a* through 1000*f*. Bach of these burners comprises a premixture injection nozzle 2, an air damper 7, a rectifier plate 3, an air supply pipe 5,.and a fuel nozzle 4. The fuel nozzle 4 has a plurality of openings, through which the fuel is dispersed and fed into the air flow. The zone downstream of the fuel nozzle 4 is the mixing zone. The rectifier plate 3, which is a honeycomb-structured resistor, has a rectifying function to form a flow of uniform speed distribution and also has a function to prevent a backfire of the premixture flame since the outlet velocity is increased as the passage cross section is reduced. A strip-shaped flame holder 1 is disposed near the outlet of premixture injection nozzle 2 to extend perpendicular to a direction of the mainstream of the mixture. The lengths of the sides of the flame holder are shorter than the corresponding sides of the premixture injection nozzle 2. The reason is that if the longitudinal length of the side of the flame holder 1 is longer than that of the corresponding side of the premixture injection nozzle 2, a part of the mixture flow is bent and injected at right angles to the mainstream, thereby deteriorating the stability of the flame.

When the boiler is started up, the diffusion combustion burner 6 is used, and as the boiler load is increased, the mixture of fuel and air is injected from the premixture flame burner apparatus 1000. The premixture flame burner apparatus, in this embodiment, first injects the mixture from one of the size burners 1000*a*–1000*f*, and, as the load increases, the mixture is injected from the other burners successively. The diffusion flame burner 6 is used to stabilize the premixture flame. However, if the premixture flame is stably formed, no fuel and air is injected from the diffusion flame burner 6.

As shown in FIG. 2, a fuel nozzle 11 is installed coaxially with respect to the diffusion flame burner 6, and an air nozzle 10 surrounds the fuel nozzle 11. A flame holder 9 is provided above an upper end of the fuel nozzle 11 to stabilize the diffusion flame. A swirl flow generator 8 installed at the air nozzle 10 promotes mixing of fuel and air, thereby shortening the diffusion flame. The premixture flame burner 6 includes the fuel nozzle 4 having a plurality of openings, provided upstream of the premixture injection nozzle 2. The gaseous fuel supplied from the fuel nozzle 4 and air supplied from the air supply pipe 5 are uniformly mixed before the mixture is injected from the premixture injection nozzle 2. The quantity of combustion air is controlled by the air damper 7. The rectifier plate 3 rectifies the flow of air and serves as a flame arrester to prevent a backfire of the premixture flame. The flame holder 1 in a strip form is provided downstream of the premixture injection nozzle 2 to stabilize the premixture flame. The flame holder 1 has an area smaller than the premixture injection nozzle 2.

Figure 3:
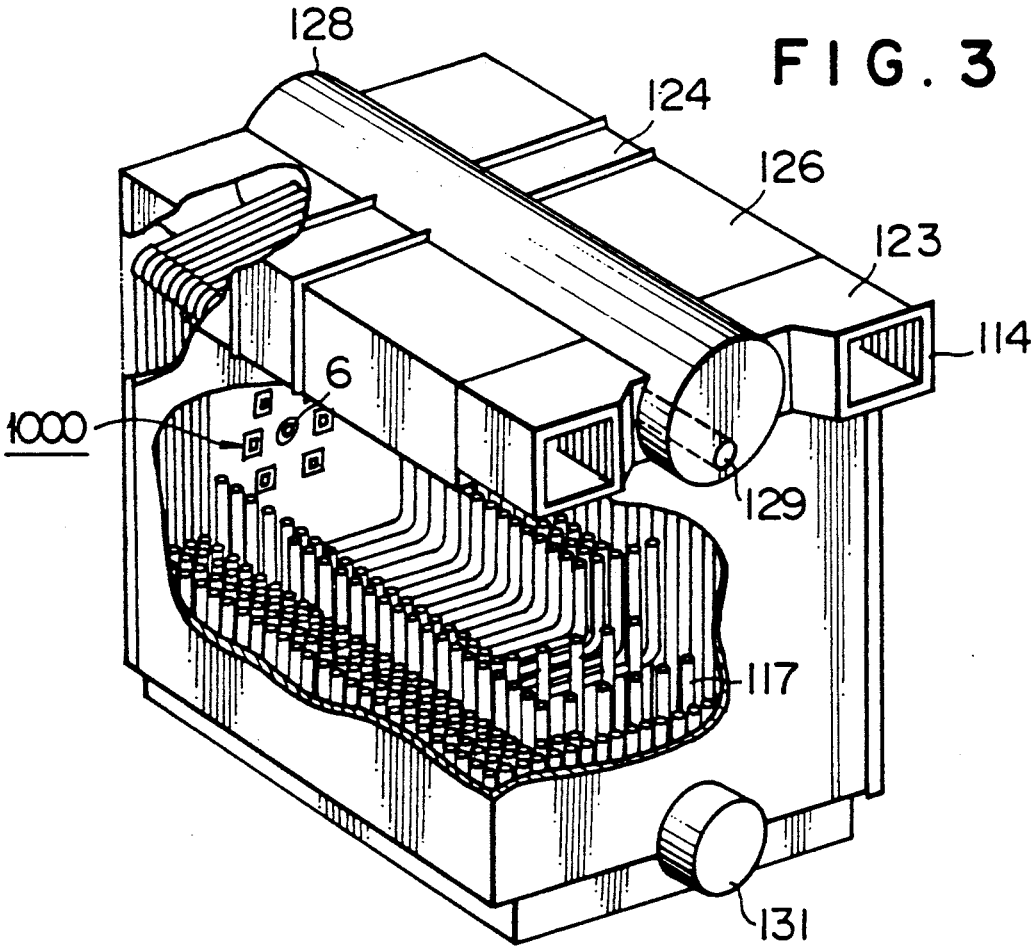
FIG. 3 is a partially broken away schematic perspective view of the low-NOx boiler in which the burner of FIG. 1 is installed.

FIG. 3 shows a boiler in which the burner of FIG. 1 is installed. The boiler is a natural circulation type water pipe boiler, with water stored in a water drum 131, being introduced through heat transfer pipes 117 into a steam drum 128. In the steam drum 128, water is separated from steam and returned to the water drum 131, while the steam is accumulated in a seam reservoir 129. As described more fully hereinbelow, it is desirable that the premixture flow should spread over a space greater than a burner diameter, and that the nozzle injection outlets of the premixture burner apparatus be located flush with the furnace wall. The combustion gas is discharged through an exhaust gas duct 114 to the outside of the boiler. In this process, the uncombusted gas is combusted by a combustor 126.

The combustion gas flows in a direction opposite to the flow direction of the premixture in the exhaust gas duct 114, and is preheated by a first air preheater 123 and a second air preheater 124 at the front and the rear stages of the uncombusted gas combustor 126, respectively.

According to the invention, the generation of NOx does not depend on the combustion load and the flame can be shortened. Therefore it becomes possible to increase a heat load of the boiler above 2,000,000 kcal/$m^3$h. The flame length can be normally shortened to less than 50 cm. It is enough that the depth of the boiler is only about 50 m. The boiler according to this invention can increase a capacity thereof by only expanding the furnace in the longitudinal direction of the water drum and the steam drum to increase the heat transfer area. This can be attained by use of a premixture flame burner with a flame holder because, even if the burner capacity is increased, the flame length hardly changes. Needless to say, by increasing the number of premixture nozzles, the boiler capacity can be increased.

Figure 4:
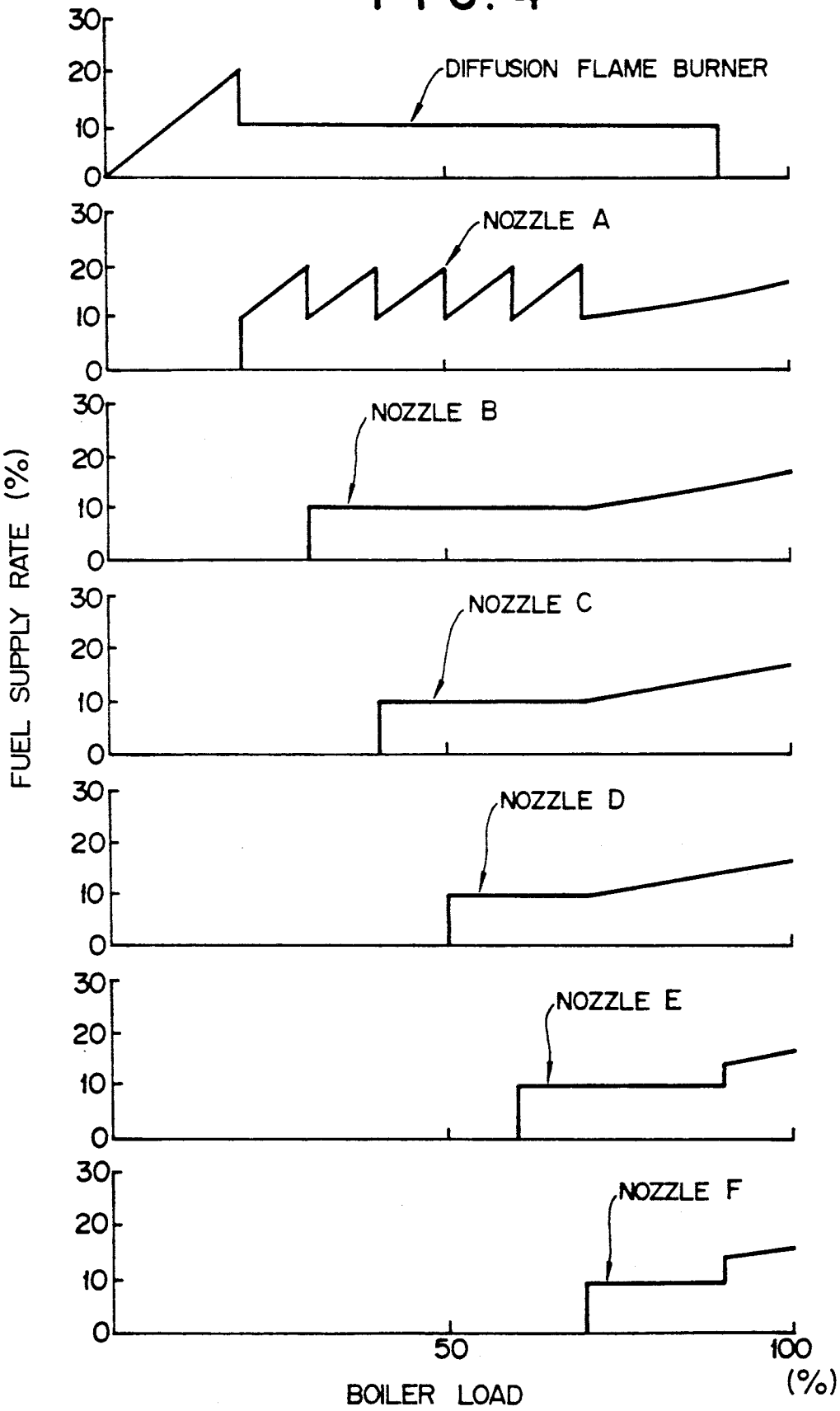
FIG. 4 is a graphical illustration of the relationship between a boiler load and fuel supply rates.

In FIG. 4, the fuel supply rate along the ordinate represents, in percentage, the ration of fuel used by the respective nozzle to the fuel used by the boiler when the boiler load is 100%. Up to 20% boiler load, only the diffusion flame burner is used, and when the load reaches 20%, the nozzle A (the premixture burner 1000*a* with a flame holder) feeds fuel and air. At this time, in order to prevent the flame from going back into the nozzle, namely to prevent a backfire, it is safe to keep the injection velocity of the premixture at 20 m/s or more. Therefore, in order to inject the premixture of an air ratio of 1.1 at the velocity of 20 m/s from the nozzle A, the quantities of fuel and air from the diffusion flame burner corresponding to this air ratio are decreased and the quantities of fuel and air corresponding to such decreased quantities are injected from the nozzle A. Then, until the boiler load reaches 30%, the quantities of fuel and air injected from the nozzle A are increased. When 30% is reached, a premixture of an air ratio of 1.1 is injected from the nozzle B (the premixture burner 1000*b* with a flame holder) at 20 m/s. The premixture injected from the nozzle A is decreased by a quantity of the premixture corresponding to the quantity of the premixture injected from the nozzle B. When the boiler load reaches 40%, 50%, 60% and 70%, the similar operation is repeated and the premixture is injected from the nozzle C (the premixture flame burner 1000*c* with a flame holder), the nozzle D (the premixture flame burner 1000*d* with a flame holder), the nozzle E (the premixture flame burner 1000*e* with a flame holder), and the nozzle F (the premixture flame burner 1000*f*) in that order. When the load is changed from 70% to 90%, the quantities of the premixture fed from the nozzles A, B, C and D are changed accordingly. When the load reaches 90%, the use of the diffusion flame burner is stopped, and the premixture including the quantities of fuel and air corresponding to those injected from the diffusion flame burner is fed from the nozzles E and F. When the load changes from 90% to 100%, the quantities of the premixture fed from the nozzles A, B, C, D, E and F are changed accordingly.

Figure 5:
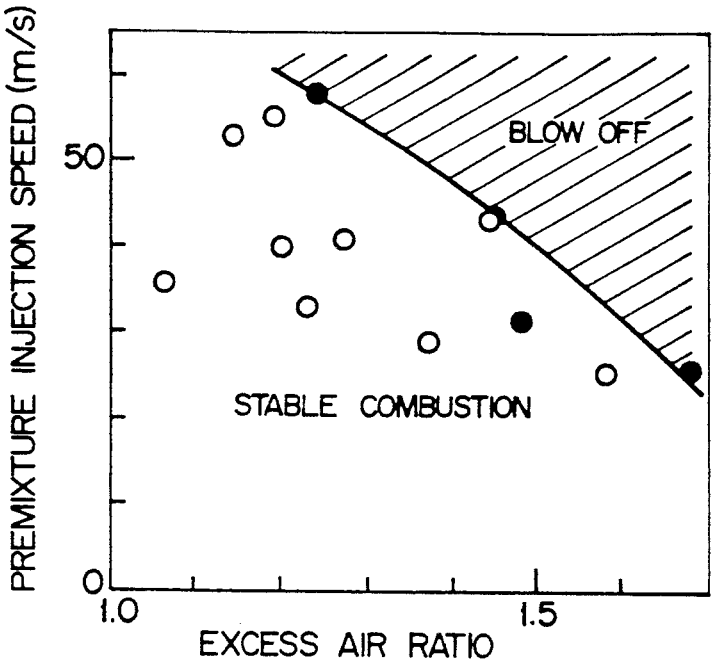
FIGS. 5, 6 and 8 are graphical illustrations of combustion characteristics of the low-NOx boiler.

FIG. 5 shows the result of study into the blowout limit of the premixture flame stabilized by a flame holder disposed downstream of the premixture injection outlets. In FIG. 5, abscissa represents the excess air ratio of the premixture and the ordinate represents the injection velocity of the premixture, with the white dots representing stable combustion of the premixture flame and the black dots representing unstable premixture flame and blow outs. It will be understood that the stable combustion range of the premixture flame stabilized by the flame holder becomes narrower as the excess air ratio increases. As is apparent from FIG. 5, when operating a boiler, by setting the excess air ratio of the premixture in a range of 1.0 to 1.3, the stable combustion of the premixture can be obtained at the injection velocity of about 50 m/s. Based on this result, in operating the boiler of FIG. 3, when the premixture injection velocity is set at 50 m/s at 25% fuel supply rate to the nozzle A, if the boiler load is reduced by decreasing the premixture injection velocity while maintaining the excess air ratio of the premixture constant, the premixture injection velocity at the boiler load of 10% becomes 20 m/s, and therefore the premixture flame can stably burn without backfire.

Figure 7A:
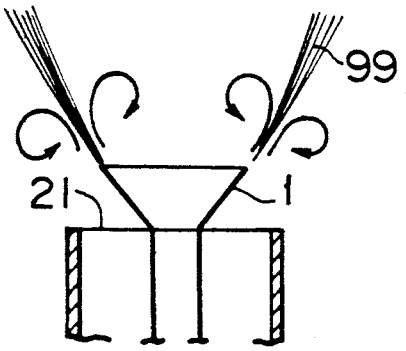
FIGS. 7A and 7B are schematic cross-sectional views respectively showing flame forms of the burners with and without a flame 25 holder.

FIG. 7A shows a burner according to the invention with a flame holder for stabilizing the premixture flame. Swirls of the premixture, indicated by the arrows in FIG. 7A are formed near the peripheral edge of the flame holder 1 disposed downstream of a premixture injection outlet 21, with an ignition then occurring in this area. After the ignition, as the injection quantity of the premixture is increased, high-temperature combustion products circulate inside and outside the premixture flame 99 as indicated by the arrows. As a result, since the energy can be supplied continuously to the premixture, the premixture flame is stably formed.

Figure 7B:
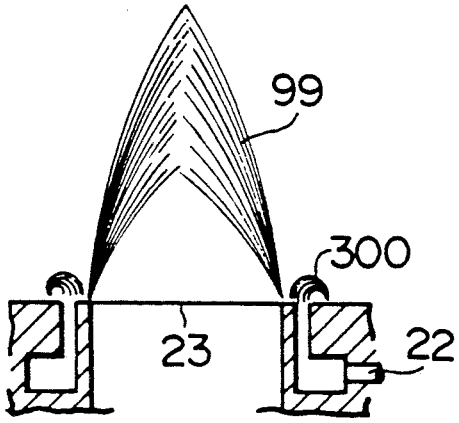

FIG. 7B shows a burner in which the premixture flame is stabilized by means of a pilot flame. The premixture of an excess air ratio of about 1.0 is supplied to the premixture supply pipe 22 to form a stable pilot flame 300 at an annular nozzle provided around the outer periphery of the cylindrical premixture injection outlet 23. The premixture from the premixture injection outlet 23 receives energy from the pilot flame 300, so that the premixture flame 99 is formed as shown in FIG. 7B. At an excess air ratio of 1.05, the premixture flame with the pilot flame generates NOx of about 800 ppm, while the premixture flame with the flame holder generates NOx of no more than 25 ppm. In case that the excess air ratio of the premixture is in a range of 1.0 to 1.3, the concentration of NOx from the premixture flame with a flame holder is about one third of the NOx concentration from the premixture flame with the pilot flame. The reason why the premixture flame with a flame holder can reduce NOx is that the combustion products such as carbon dioxide gas circulate inside and outside the flame as indicated by the arrows in FIG. 7A and flow into the flame portion where combustion is in progress to reduce an oxygen partial pressure which governs the NOx generation, thereby decreasing the concentration of NOx generated.

Figure 6:
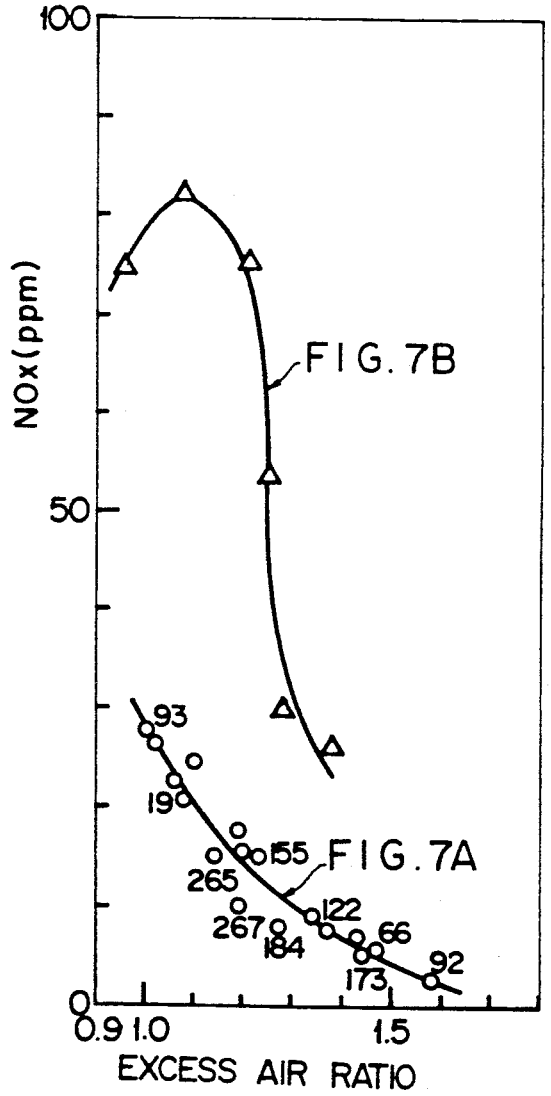

FIG. 6 shows the affects of the flame holder on the reduction of NOx of the stabilized premixture flame. In FIG. 6, the abscissa represents the excess air ratio of the premixture and the ordinate represents the concentration of NOx from the boiler. The NOx concentration is compared between the two types of premixed flame described above. In FIG. 6, the white dots represent combustion loads in units of $10^4$ Kcal/m$^3$h.

As can be seen from FIG. 6, even if the combustion load changes between $66\times10^4$ Kcal/m$^3$h and $267\times10^4$ Kcal/m$^3$h, the NOx concentration hardly changes. Therefore, by using the premixture combustion method relating to the invention, a high-load and low-NOx boiler can be realized.

Figure 8:
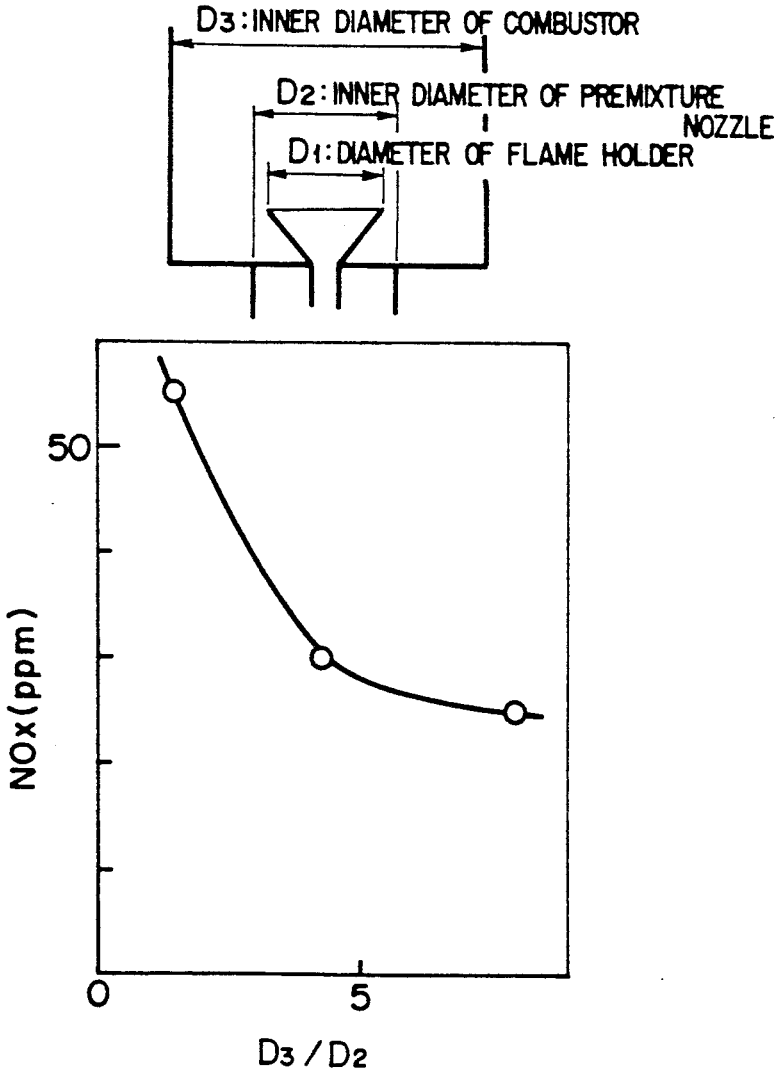

FIG. 8 shows the affect of the ratio of a combustion inner diameter D3 to the premixture nozzle inner diameter D2 on the concentration of NOx generated from the premixture flame of the premixture flame burner with a flame holder. As will be apparent from FIG. 8, in case that D3/D2 is smaller than 4, the NOx concentration is high. As the combustor inner diameter D3 is reduced, it is difficult for the combustion products to circulate outside the flame, which allows an increase in the partial pressure of the oxygen, thus increasing the NOx concentration.

Figure 9A:
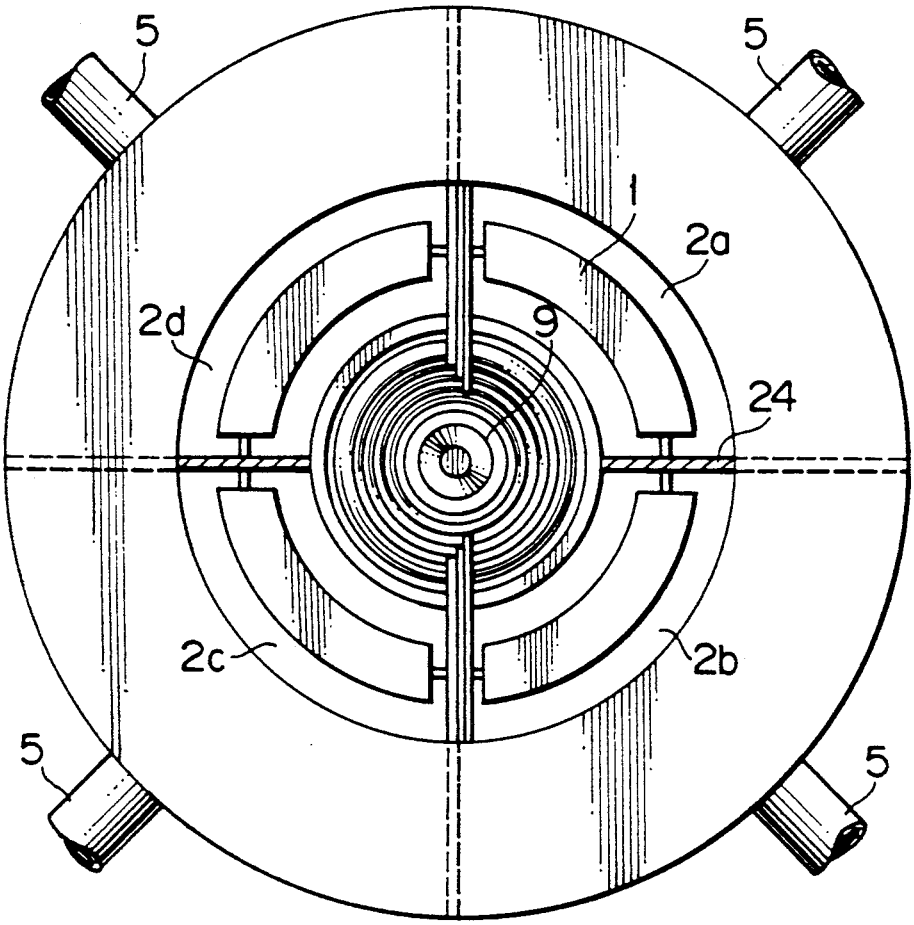
FIG. 9A is a plan view showing a burner of a low-NOx boiler according to another embodiment of the invention.
Figure 9B:
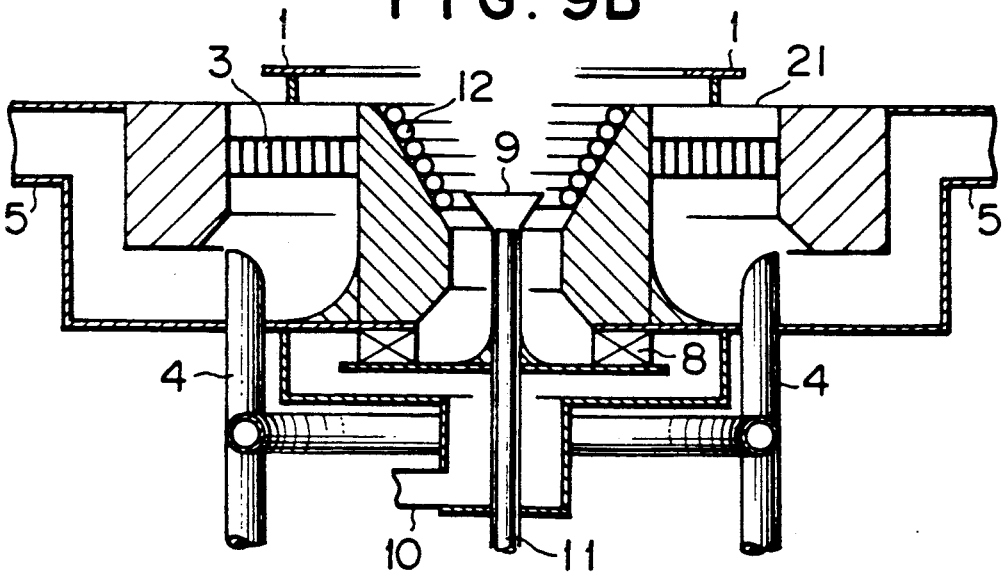
FIG. 9B is a cross-sectional view of the burner of FIG. 9A.

The burner apparatus of FIGS. 9A and 9B comprises a cylindrical diffusion flame burner with a flame holder disposed in the center, and an annular premixture flame burner with a flame holder disposed around the diffusion flame burner. The premixture flame burner is composed of four nozzles *2a, 2b, 2c* and *2d*, into which an annular flow passage is divided. Each nozzle has a fuel-air mixing zone disposed upstream of the injection outlet 21 and a mixture rectifier 3 located between the mixing zone and the injection outlet 21. The fuel is diffused through the fuel nozzle having a plurality of outlets into the air flow to be mixed together. The rectifier 3 is a flow-passage resistor of honeycomb structure. At each nozzle outlet a strip-shaped flame holder 1 is so disposed as to extend perpendicular to the direction of the flow of mixture. The sides of the flame holder are shorter than the corresponding sides of the nozzle.

When the boiler is started up, first the diffusion combustion burner disposed in the center of the burner is used, and as the boiler load is increased, the fuel-air mixture is injected from the premixture burner with the flame holder. In connection with an operation of the premixture combustion burner, in this embodiment, the mixture is at first injected from one of the four nozzles *2a, 2b, 2c* or *2d*, and as the load increases, the premixture is injected from the other nozzles in succession. The diffusion flame burner is used to stabilize the premixture flame. However, when the premixture flame is stably formed, the injection of fuel and air from the diffusion flame burner is stopped.

Figure 10:
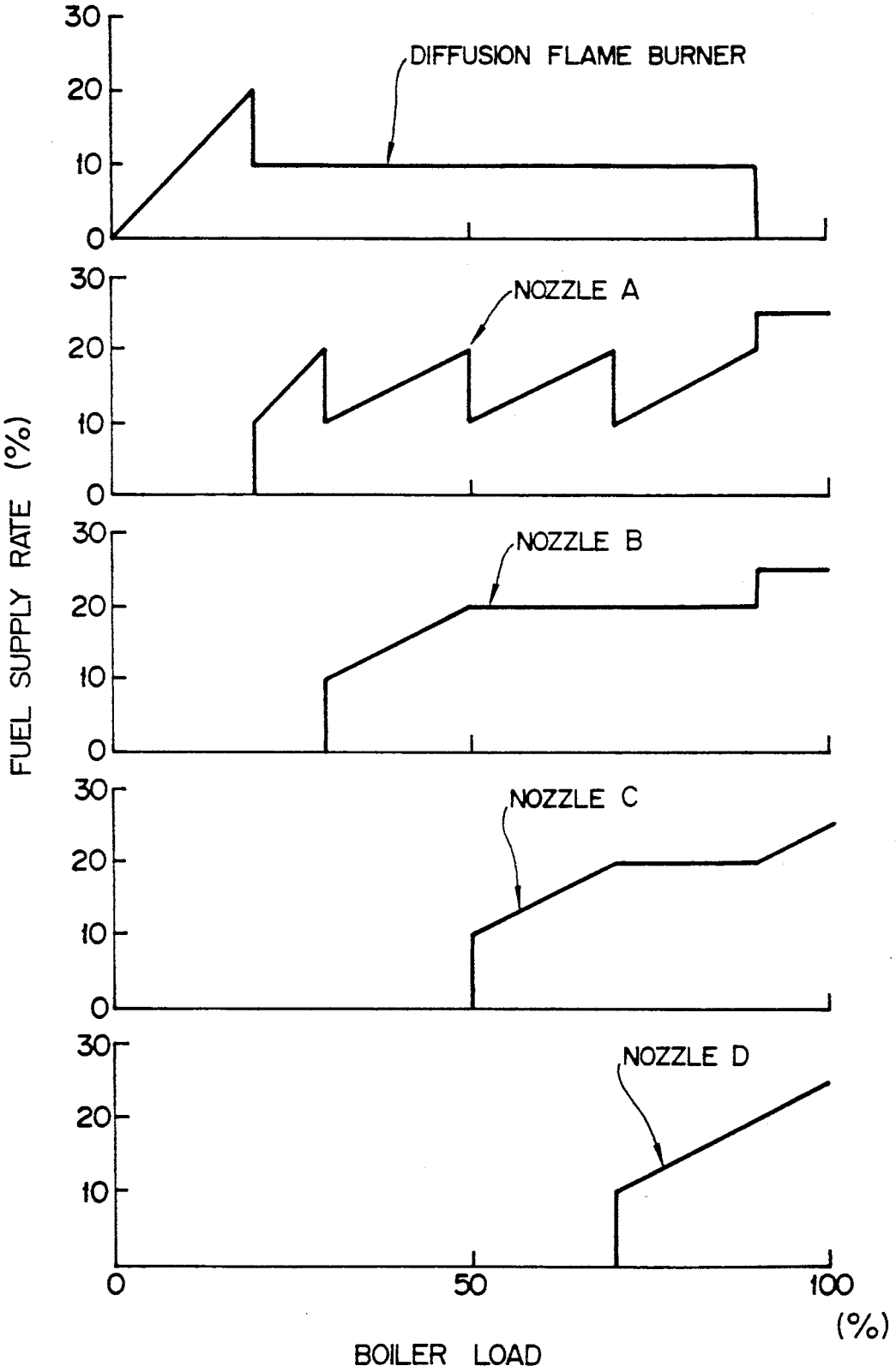
FIG. 10 is a graphical illustration of the relationships between a boiler load and fuel supply rates.

FIG. 10 shows a relation between the boiler load equipped with the low-NOx burner of FIGS. 9A and 9B and the fuel supply rate from each nozzle. The fuel supply rate along the ordinate represents the ratio, in percentage, of the fuel used by each nozzle to the fuel used by the boiler when the boiler load is 100%. Up to a boiler load of 20%, only the diffusion flame burner is used, and when the load reaches 20%, fuel and air are fed through the nozzle A, an arbitrary one of the four nozzles. At this time, in order to prevent the flame from withdrawing back into the nozzle, i.e. to prevent a backfire, it is safe to maintain the injection velocity of the premixture at 20 m/s or higher. Therefore, in order to inject the premixture of an air of 1.1 from the nozzle A at the velocity of 20 m/s, the fuel and air injected from the diffusion flame burner is reduced by quantities thereof corresponding to those injected from the nozzle A, and fuel and air thus reduced are injected from the nozzle A. The fuel and the air injected from the nozzle A are increased until the boiler load reaches 30%, and when 30% is reached, the premixture of air ratio of 1.1 is injected at the velocity of 20 m/s from the nozzle B, another arbitrary one of the remaining three nozzles. At this time, the premixture injected from the nozzle A is reduced by a quantity of the premixture corresponding to that of the premixture injected from the nozzle B. When the load reaches 50% and 70%, the similar operation is repeated. Namely, the premixture is injected from the nozzle C, an arbitrary one of the remaining two nozzles when the load is 50% and the premixture is injected from the nozzle 0, the last one of the four nozzles when the load is 70%. When the load reaches 90%, the use of the diffusion flame burner is stopped, and the nozzles A and B inject the quantity of the premixture corresponding to the quantities of fuel and air which have been injected from the diffusion flame burner. When the load is changed between 90% and 100%, the quantities of the premixture injected from the nozzles C and D are changed accordingly.

Figure 11:
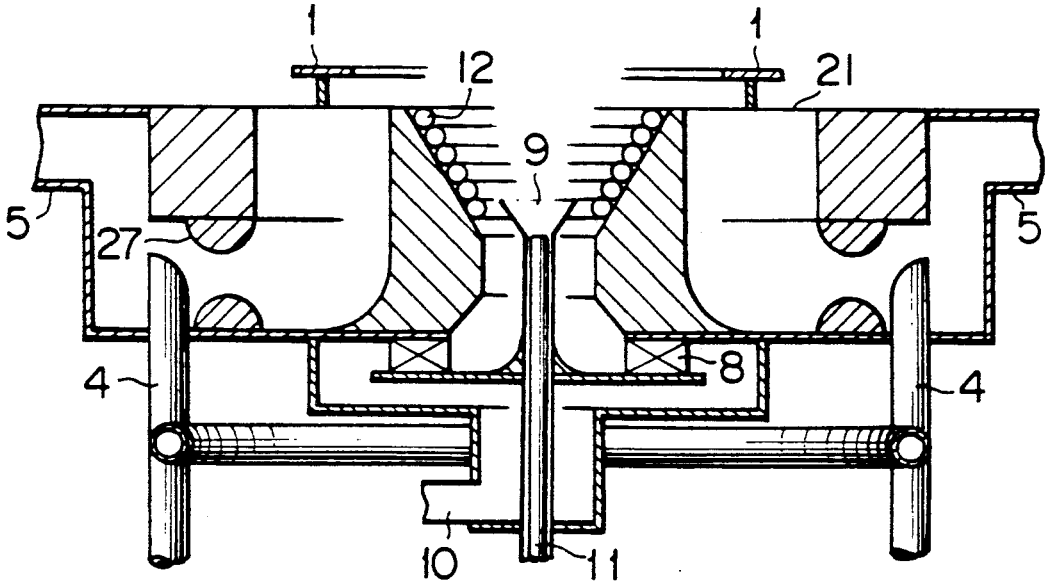
FIG. 11 is a cross-sectional view showing of a burner of a low-NOx boiler according to yet another embodiment of the invention.

The embodiment of FIG. 11 features the use of hemispherical Venturi portions 27 as rectifying means to form a uniform premixture of gaseous fuel and combustion air. The construction except for the Venturi portions 27 is the same as in FIGS. 9A and 9B.

Figure 12A:
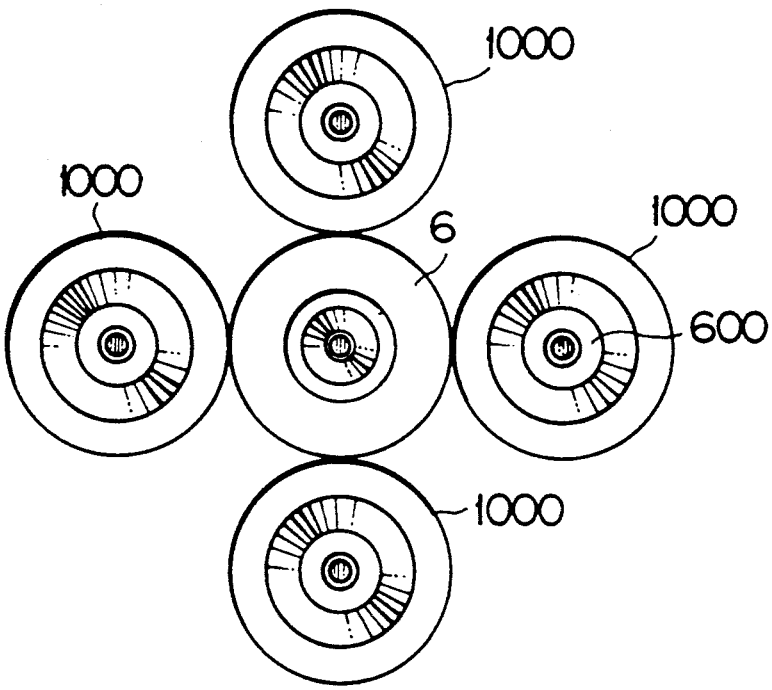
FIG. 12A is a schematic plan view showing a burner of a 10 low-NOx boiler according to a further embodiment of the invention.
Figure 12B:
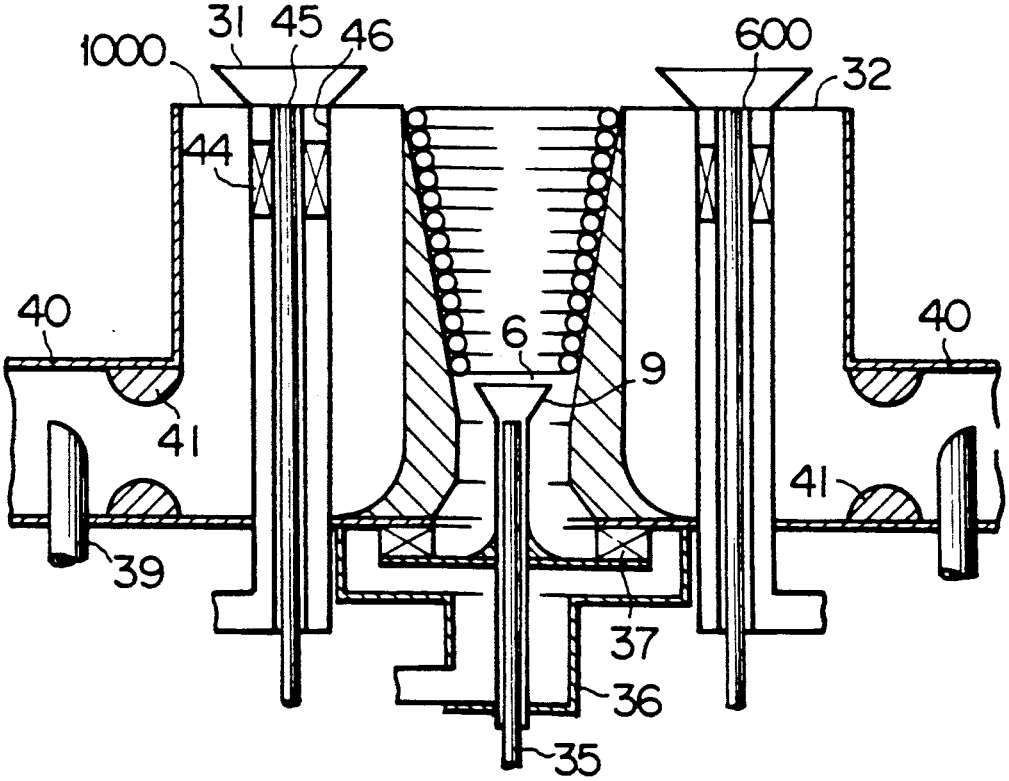
FIG. 12B is a schematic plan view of a sectional view of the burner of FIG. 12A.
Figure 13A:
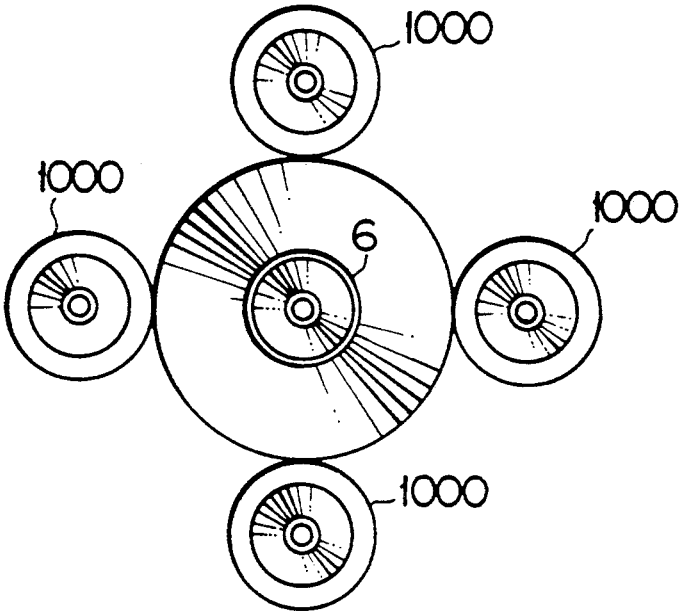
FIG. 13A is a burner of a low-NOx boiler according to a still further embodiment of the invention.
Figure 13B:
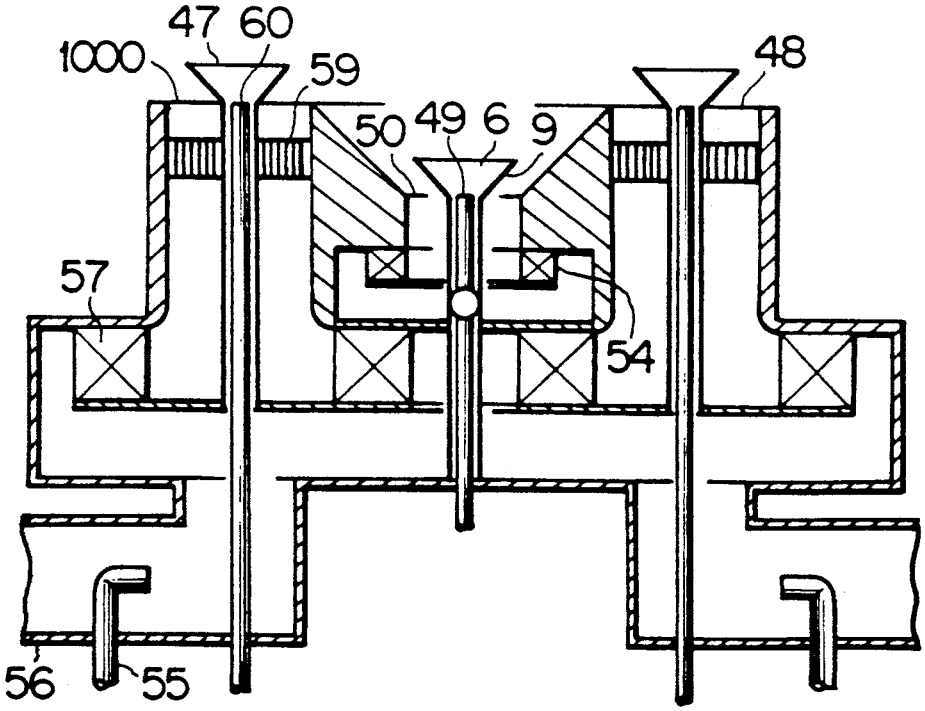
FIG. 13B is a sectional view of the burner of FIG. 13A.

FIGS. 12A and 12B show the construction of a burner apparatus for a low-NOx boiler, having a plurality of cylindrical premixture nozzles. The burner apparatus comprises a first cylindrical diffusion flame burner 6 for ignition disposed at the center thereof, and a plurality of premixture flame burners 1000 each having a flame holder, disposed to surround the diffusion flame burner 6. Each of the premixture flame burners 1000 has a second cylindrical diffusion flame burner 600 for ignition disposed coaxially with the injection outlet 32 of the premixture nozzle. In the first diffusion flame burner 6, a fuel nozzle is provided coaxially with respect to an axis of the burner, and an air nozzle 36 is disposed around the fuel nozzle 35. The air nozzle 36 has a swirl flow generator 37 mounted therein so as to control the swirl strength of combustion air. The premixture flame burner 1000 has a fuel nozzle 39 for premixture combustion disposed upstream of the premixture injection outlet 32. The gaseous fuel from the fuel nozzle 39 and the combustion air from an air supply pipe 40 are mixed to form a uniform premixture through a Venturi portion 41. The second diffusion flame burner 600 is disposed coaxially with the premixture injection outlet 32, and a fuel nozzle 45 is disposed coaxially with the diffusion flame burner 600. An air nozzle 46 is disposed to surround the fuel nozzle 45. The air nozzle 46 is provided with a swirl flow generator 44 which serves to shorten the diffusion flame of the second diffusion flame burner. When ignition of the first diffusion flame burner for ignition the premixture from the premixture injection outlet 32 is difficult, the second diffusion flame burner ignites the entire premixture. The above-mentioned two types of diffusion flames are used to ignite the premixture when the boiler load is changed. A flame holder is provided at an upper end of the air nozzle 46, with the flame holder 31 causing a circulating flow of the premixture near the peripheral edge of the flame holder, thereby improving the stability of the premixed flame. Furthermore, the flame holder 31 causes combustion products to be circulated inside and outside the flame, so that NOx can be reduced. FIGS. 13A and 13B show a modification of the burner for a low-NOx boiler, provided with a plurality of cylindrical premixture injection outlets. The burner comprises a first cylindrical diffusion flame burner 6 for ignition and a plurality of premixture flag burners 1000 disposed surrounding the diffusion flame burner 6, The burner 1000 has fuel nozzle 60 for the second diffusion flame provided coaxially with the axis of the premixture outlet 48. The first diffusion flame burner 6 has a fuel nozzle 49 provided coaxially therewith and an air nozzle 50 surrounding the fuel nozzle 49. The air nozzle 50 has a swirl flow generator 54 installed therein to control the swirl strength of the combustion air. In the premixture flame burner 1000, a fuel nozzle 55 for premixture combustion is disposed upstream of the premixture injection outlet 48.

The fuel from the fuel nozzle 55 and the combustion air from the air supply pipe 56 are mixed to form a uniform premixture by the swirl flow generator 57. A rectifying means 59 is provided between the swirl flow generator 57 and the premixture injection outlet 48, with the rectifying means 59 serving to form a uniform speed distribution of the premixture in the radial direction of the outlet 48. A fuel nozzle 60 for the second diffusion flame is disposed coaxially with respect to the outlet 48. If ignition of the first diffusion for igniting the premixture from the outlet 48 is difficult, the second diffusion flame is formed to ignite the entire premixture. The above-mentioned two types of diffusion flames are used to ignite the premixture when the boiler load is changed. A flame holder 47 is provided at a position downstream of the premixture injection outlet 46, with the a flame holder 47 causing a circulating flow of the premixture near the peripheral edge of the flame holder, thereby improving the stability of the premixture flame. Furthermore, the flame holder 47 cause combustion products to be circulated inside and outside the flame, so that NOx can be reduced.

Figure 14A:
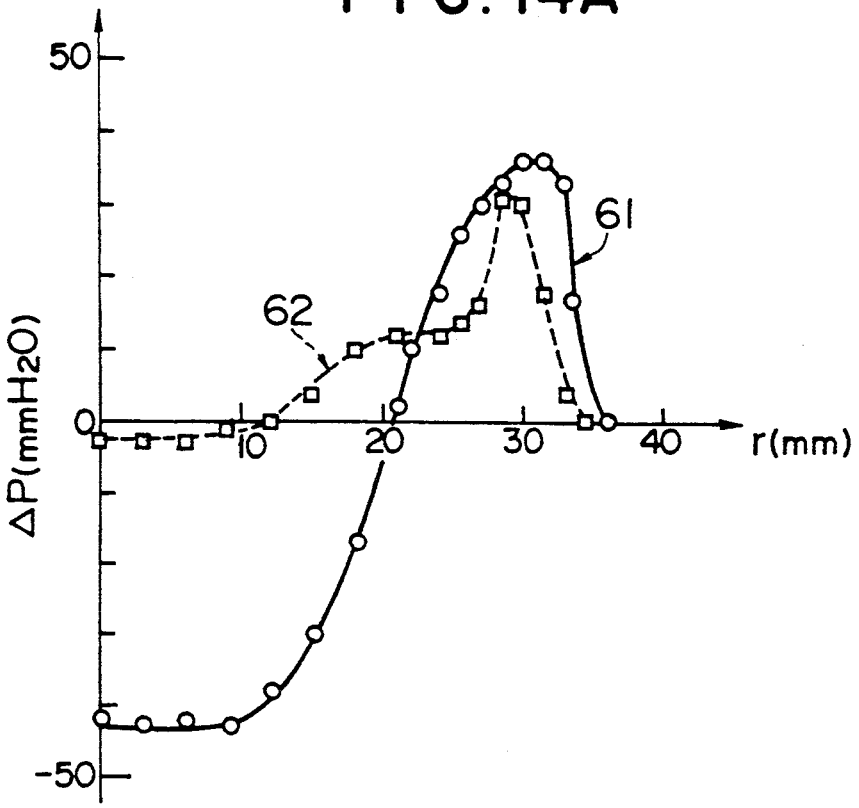
FIGS. 14A and 14B are graphical illustrations depicting the effects of rectifying means.
Figure 14B:
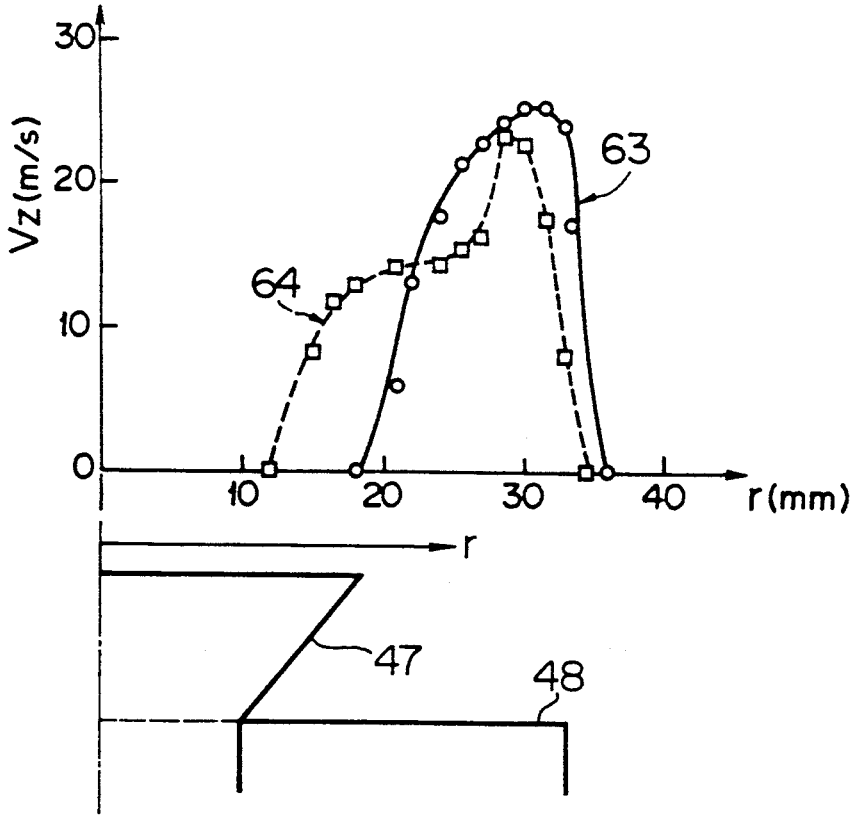
Figure 15:
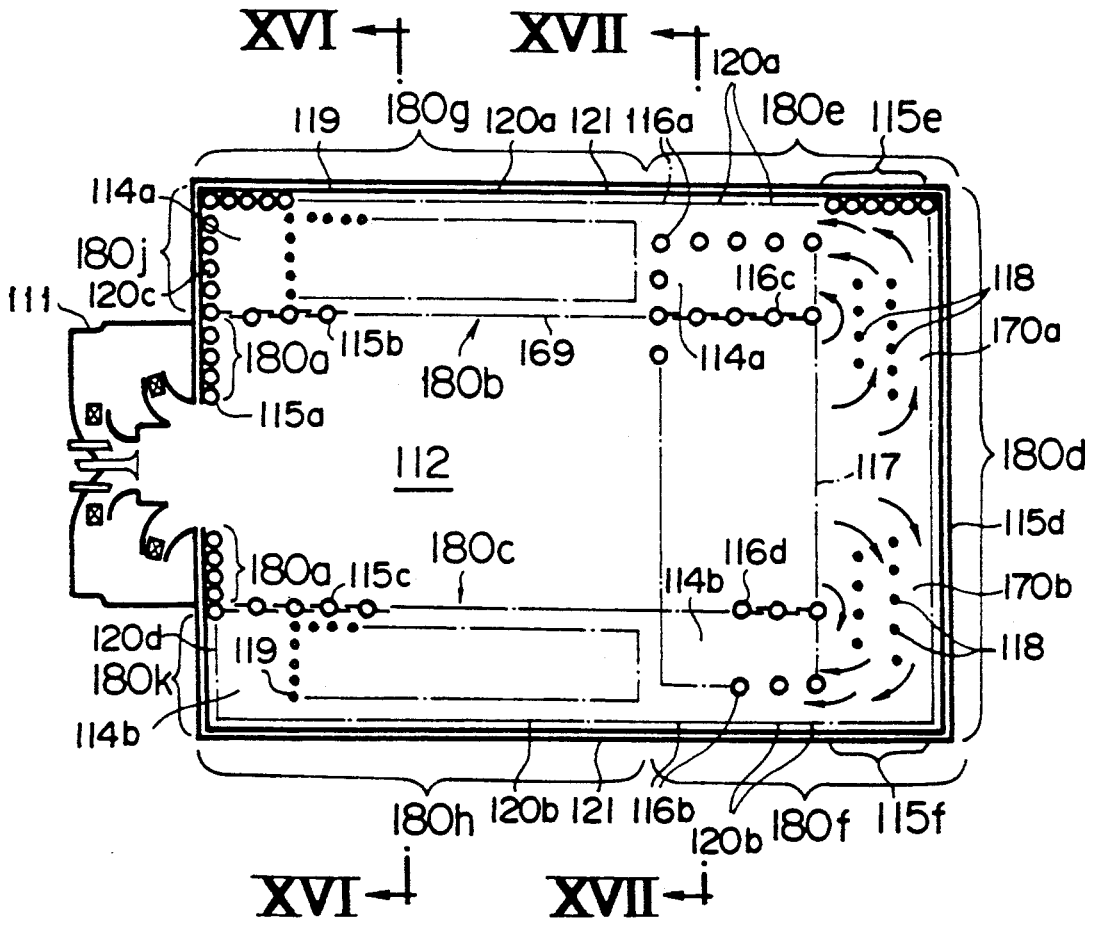
FIG. 15 is a cross-sectional view of a boiler according to another embodiment of the invention.
Figure 16:
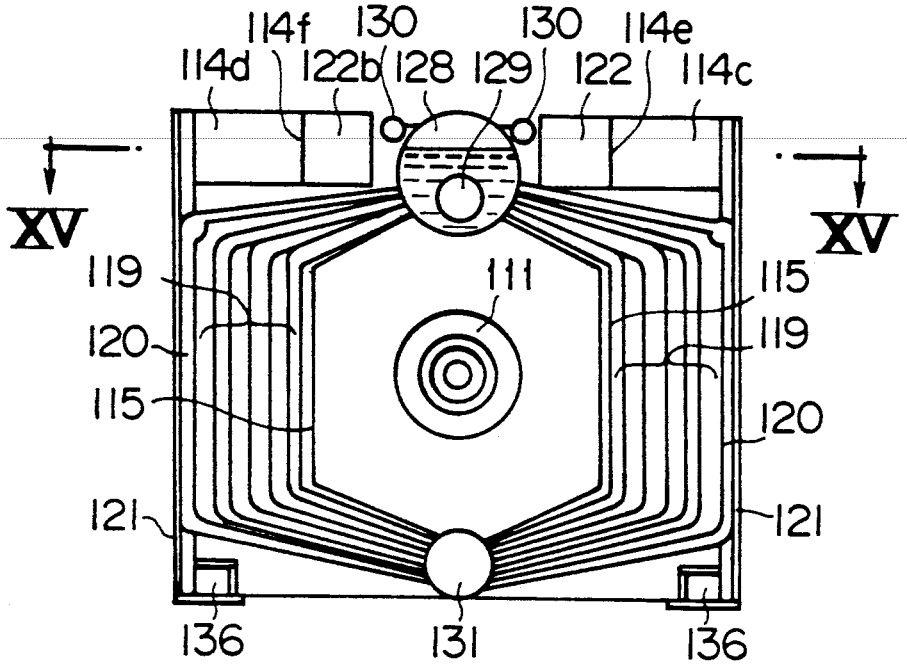
FIG. 16 is a sectional view taken along the line XVI—XVI in FIG. 15.
Figure 17:
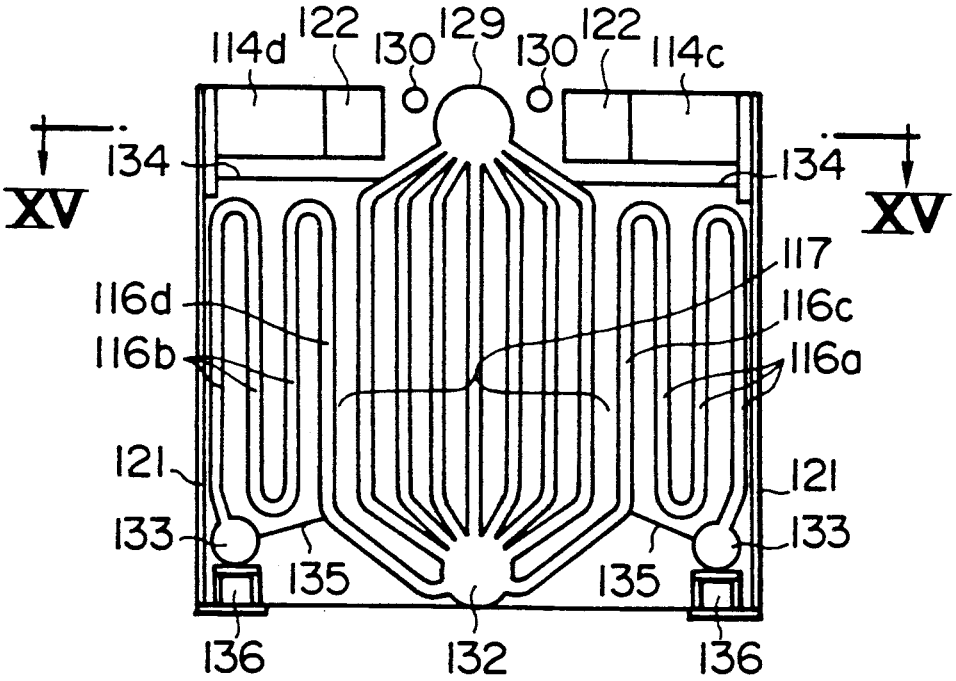
FIG. 17 is a sectional view taken along the line XVII—XVII of FIG. 15.
Figure 18:
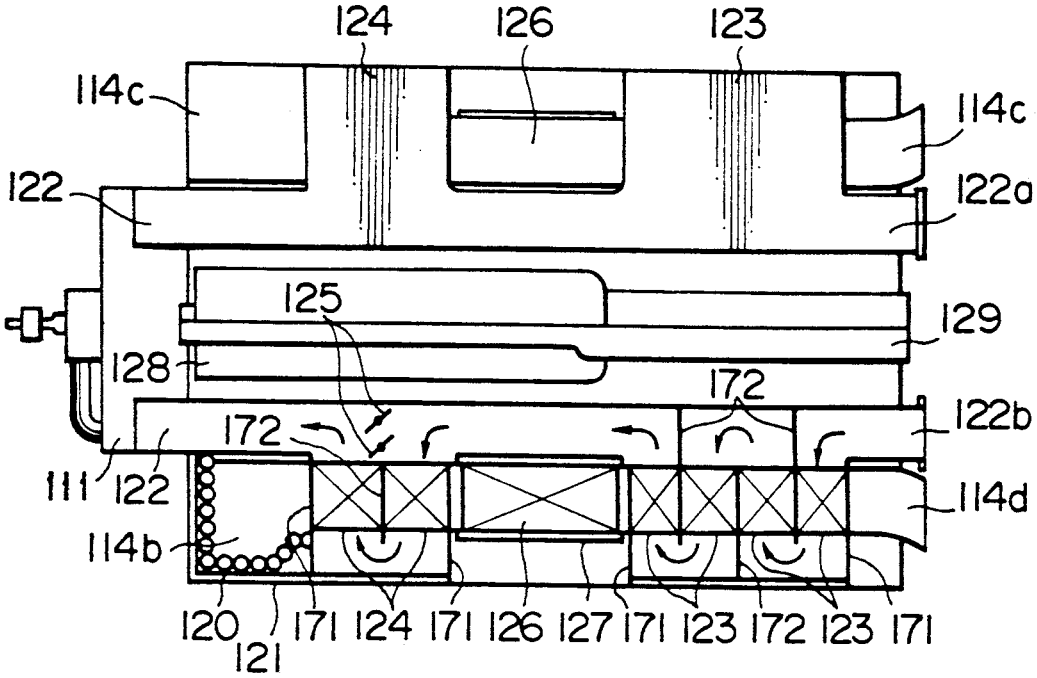
FIG. 18 is a sectional view taken along the line XVIII—XVIII of FIGS. 16 and 17.

FIGS. 14A and 14B illustrate the effect obtained due to the rectification of the premixture of gaseous fuel and air by the rectifier 59 shown in FIGS. 13A and 13B, with FIG. 14A showing the pressure distribution along the radial direction of the premixture injection outlet 48 measured by the Pilot tube, and FIG. 14B showing the speed distribution of the premixture along the radial direction of the outlet 48. A flared peripheral edge of a flame holder 47 is located at 20 mm in radial direction from the axis of the holder 47, while a base peripheral edge of the holder 47 is located at 10 mm in the radial direction. A peripheral edge of the premixture injection outlet 48 is located at about 33 mm in the radial direction from the axis of the holder 47. In FIGS. 14A and 14B, solid lines 61 and 63 represent the pressure and the speed distributions when no rectifying means is provided, and broken lines 62 and 64 represent the pressure and the speed distributions when a honeycomb structure is installed as rectifying means. As shown by the solid line 61 in FIG. 14A, when no rectifying means 59 is provided, a negative pressure zone is spread up to a radial position about 20 mm from the axis of the holder 47 due to the action of the swirl flow generator 57. As shown by the solid line 63 in FIG. 14B, when no rectifying means 59 is provided, the premixture accumulates near the outer periphery of the outlet 48 due to a centrifugal force caused by the swirl flow generator 57, so that the premixture is not accumulated above the flame holder 47. Consequently, the premixture flame is located at the outer periphery of the outlet 48. The high-temperature exhaust gas caused by the premixture flame is drawn into the negative pressure zone extending around the center portion of the outlet 48, so that a flame is formed from within the outlet 48 resulting in a deterioration of the flame holder 47 as it is heated from the upstream side thereof. When a honeycomb is installed as rectifying means 59, as shown by the broken lines 62, a negligible negative pressure zone is generated, and the premixture is distributed above the flame holder 47, as indicated by the broken line 64 of FIG. 14B. As a result, a circulating flow as shown in FIG. 7A is formed near the flared peripheral edge of the flame holder 47, whereby the premixture flame is stabilized.

With reference to FIGS. 15 through 20, the following description will be made to a boiler having a primary combustion chamber provided in the burner, in which combustion is executed with a low air ratio of 1 or below so as to obtain a high load and low NOx combustion.

A furnace 112 comprises a plurality of radiant heat transfer pipes 115*a* arranged mutually adjacent on the upstream side (left side in FIG. 15) to form a furnace front wall 180*a*, with radiant heat transfer pipes 115*b* and 115*c* being arranged to form walls extending from the opposite ends of the furnace front wall 180*a* and extending perpendicular thereto towards the downstream side (right side in FIG. 15) so that a combustion chamber is defined therebetween. Steam generating pipes 116*c* and 116*d* are arranged as extensions, on the downstream side, from the walls formed of the radiant heat transfer pipes 115*b* and 115*c*, and steam heat transfer pipes 117 located between walls of the stream generating pipes 116*c* and 116*d*. A steam drum 128, extending from the upstream side to the downstream side of the furnace 112, is provided at an upper center position of a region between the radiant heat transfer pipe 115*b* and 115*c*. A water drum 131 is provided at a bottom center position in parallel with the steam drum 128. The radiant heat transfer pipes 115*a*, 115*b* and 115*c* are connected at their lower ends with the water drum 131 and, at their upper ends, with the water phase in the steam drum 128. A steam distribution pipe 132 is disposed along an extension of an axis of the water drum 131 in the center of the furnace bottom between the walls of the steam generating pipes 116*c* and 116*d*. A steam reservoir 129, in parallel with the axis of the steam drum 128, at an upper center position of the furnace above the steam distribution pipe 132. The steam reservoir 129 extends into the steam drum 128 on the upstream side and located under the surface of the water in the steam drum 128. The steam generating pipes 116*c* and 116*d* are connected at their lower ends to the steam distribution pipes 132. Each of the radiant heat transfer pipes 115*b* and 115*c* and the steam generating pipes 116*c* and 116*d* is integrally provided at upstream and downstream sides with plates 169. The adjacent flat plates 169 are partially overlapping each other to constitute the furnace side walls 180*b* and 180*c*.

Heating passages 170*a* and 170*b* horizontally separating to the left and right sides are provided on a downstream portion of the furnace 112. The heating passages 170*a* and 170*b* are defined by a radiant heat transfer pipe 115*d*, radiant heat transfer pipes 115*f* and 115*e*, steam heat transfer pipes 117, steam generating pipes 116*a* and 116*b*, downcast pipes 120*a* and 120*b*, and steam generating pipes 116*c* and 116*d*. The pipe 115*d* is spaced from the steam generating pipes 116*c* and 116*d* constituting the downstream side end portions of the furnace side walls 180*b* and 180*c* and the pipe 115*d* also constitutes a heating-passage rear wall 180*d* parallel with the furnace front wall 180*a* and wider than the furnace front wall 120*a*. The radiant heat transfer pipes 115*e* and 115*f* extend from the opposite ends of the boiler rear wall 180*d* towards the upstream side and form part of the heating-passage side walls 180*e* and 180*f* parallel with the furnace side walls 180*b* and 180*c*. The steam heat transfer pipes 117 are, on the extreme downstream side, disposed between the furnace side walls 180*b* and 180*c*. The steam generating pipes 116*a* and 116*b* are disposed adjacent to the radiant heat transfer pipes 115*e* and 115*f* and form part of the heating passage side walls 180*e* and 180*f*. The downcast pipes 120*a* and 120*b* are disposed between the steam generating pipes 116*a* and 116*b* and form part of the boiler side walls 180*e* and 180*f*. The steam generating pipes 116*c* and 116*d* form part of the furnace side wall 180*b* and 180*c*. The radiant heat transfer pipes 115*d*, 115*e* and 115*f* are connected at their lower ends to the water drum 131 and at their upper ends to the water phase in the steam drum 128. The steam generating pipes 116*a*, 116*c*, 116*b* and 116*d*, arranged in a plane intersecting perpendicularly to the furnace side walls, are communicated with one another to form a single pipe line via the respective bent portions. The steam generating pipes 116*c* and 116*d* are connected at their lower ends to the steam distributing pipe 132, and the steam generating pipes 116*a* and 116*b* forming the heating passage side walls are connected at their lower ends to a water reservoir 133. The reservoir 133 is arranged on the lower furnace side of the heating passage side wails 180*e* and 180*f* and along these side walls 180*e* and 180*f*. The steam generating pipes 116*a* and 116*b* have pipe sections bending a number of times up and down between the boiler side walls 180*e* and 180*f* and the steam generating pipes 116*c* and 116*d* forming the furnace side walls 180*h* and 180*c*. Therefore, the passages in the steam generating pipes 116*a* and 116*b* communicate through the steam generating pipes 116*c* and 116*d* with the steam distributing pipe 132 The steam heat transfer pipes 117 are connected at their upper ends to the steam reservoir 129 and at their lower ends to the steam distributing pipe 132. Superheaters 118 are arranged in the heating pas ages 170*a*, 170*b* and are formed as a single bent pipe comprising a plurality of pipes to each other. The superheaters 118 are connected at first ends thereof to the steam phase of the steam drum 128 through steam pipes 130, and at the opposite ends thereof to steam-applied equipment, not shown, such as a steam turbine and a chemical plant. Downcast pipes 120*a* and 120*b* are provided adjacent to the heating-passage side walls 180*e* and 180*f* and on the extensions towards the furnace front walls 180*a*, respectively. The downcast pipes 120*a* and 120*b* constitute flue side walls 180*g* and 180*h* parallel with the furnace wall side walls 180*c* and 180*d* and continuous on the extensions of the furnace front walls 180*a*. Downcast pipes 120*c* and 120*d* are arranged in the opposite extensions of the furnace front 180*a* to form flue front wall 180*j* and 180*k*.

A flue 114*a* is defined by a flue top plate 134 provided above the furnace side wall 180*b*, the flue side wall 180*g*, the flue front wall 180*j*, and the steam generating pipes 116*a* and 116*c*, and a flue bottom plate 135 is provided below the steam generating pipe 116*a*. A flue 114*b* is defined by a flue top plate 134 provided above the furnace side wall 180*c*, the flue side wall 180*h*, the flue front wall 180*k*, and the steam generating pipes 116*b* and 116*d*, and a flue bottom plate 135 provided below the steam generating pipe 116*b*.

In each of the flues 114*a* and 114*b*, in this embodiment, convection heat transfer pipes 119 are provided, for example, in twenty rows, each having five pipes 119. The convection heat transfer pipes 119 are connected at their upper ends to the water phase of the steam drum 128, and at their lower ends to the water drum 131. The downcast pipes 120*a* and 120*c* communicate at their lower ends with the water drum 1341 and at their upper ends with the water phase of the steam drum 128. Return pipes, not shown, are provided, which communicate between the bottom part of the steam reservoir 129 within the steam drum 128, and the water reservoirs 133. The return pipes are installed such that they are inclined from the steam reservoir 129 to the water reservoirs 133 to ensure that there is no air pocket in a mid-portion thereof.

Upper flues 114*c* and 114*d* are provided above the flues 114*a*, 114*b* at the substantially same height as the steam drum 128 and in parallel with the steam drum 128. The flues 114*a* and 114*b* communicate with the upper flue 114*c* and 114*d*, respectively, through openings made in the flue top plate 134. The upper flues 114 *c* and 114*d* are constructed symmetrically. So, description will be made only on the upper flue 114*d*. Combustion gas rises from the flue 114*b* through the above mentioned openings, and flows through the upper flue 114*d* in the direction opposite to the combustion gas flow in the flue 114*b*. The upper flue 114*d* includes a second air preheater 124 provided downstream of the openings, with a gas combustor 126 for combusting unburnt combustion gases being provided downstream of the second air preheater 124, and a first air preheater 123 being provided downstream of the gas combustor 126. The first air preheater 123 and the second air preheater 124 are almost identical in construction. Each preheater comprises tube plates 171 provided at the opposite ends in the direction of the combustion gas flow. A plurality of round pipes forming a smoke dust communicates between the tube plates 171, and an odd number of baffle plates 172 are provided between the tube plates 171. For example, three plates 172 may be provided for the first air preheater 123 and one plate 172 for the second air preheater 124. These smoke ducts serve as means for rectifying the flow of the exhaust gas.

The gas combustor 126 oxidizes carbon monoxide, which is the unburnt gas in the exhaust gas, to be carbon dioxide. The gas combustor 126 was made by catalyst for accelerating reaction in a plate form and disposed almost in parallel with the flow of the exhaust gas in the passage of the exhaust gas. Used is the catalyst with an active temperature in the range of 300° to 1000° C. The catalyst need not be in a plate form but may be in a grill form. It is also possible to use spheroidal bodies about 3 mm in diameter as catalyst carriers so as to form a spheroidal catalyst which may fill the exhaust gas passage.

On that side of the upper flue 114*d* which is nearer to the steam drum 126, an air supply duct 122*b* is arranged in parallel with the upper flue 114*d*. The upper flue 114*d* and the air supply duct 122*b* are adjacent to each other through the intermediary of the upper flue side plate 114*f*. The baffle plates 172 of the first air preheater 123, which include the one adjacent to the tube plate 171, are alternately extended into the inside of the air supply duct 122*b*, thereby interrupting the passage of the air supply duct 122*b*. At the position in the air supply duct 122*b* adjacent to the baffle plate 172 in the second air preheater 124, there is provided a heating control valve 125 comprising a flat plate supported by the top surface and the bottom surface of the air supply duct 122*b* and formed integrally with a rotatable post. This heating control valve 125 controls the quantity of air flowing into the second air pre-heater. The angle between the flat plate and the longitudinal direction of the air supply duct 122*b* can be controlled to change the passage cross section of the duct 122*b*. Since the upper flue side plate 114*f* is not provided at the adjoining part of the first and second air preheaters 123, and the air supply duct 122*b*, gas can flow freely between them. One end portion of the air supply duct 122*b* close to a flue front wall 180*k* is extended to the opposite side of the flue 114*b* of the flue front wall 180*k*, and communicates with a window box 173 formed around the periphery of a burner throat 143 provided in the furnace front wall 180*a* outside the furnace. The other end portion of the duct 122*b* communicates to a blower apparatus (not shown).

The window box 173 is provided coaxially with the burner throat 143, and is surrounded by a cylindrical burner outer wall 145 larger in diameter than a diameter of the burner throat, and a burner side wall 147 forming an end face of the cylinder. A burner 111 is provided at the center of the window box 173.

The burner 111 includes a primary combustion chamber 157 at the center thereof comprising a main mixture passage 212 located on the upstream side and serving as the main nozzle for forming a main combustion flame of an air ratio of 1 or less, an annular stabilizer plate 155 having pilot flame holes 155 each forming a pilot flame located to surround the main premixture passage 212, a primary combustion chamber side wall 217 disposed at the outer periphery of the stabilizer plate 155 to constitute an upstream side wall of the primary combustion chamber 157, a wall surface formed of water cooling pipes 158 disposed at the outer periphery of the primary combustion chamber side wall 217, and a cylindrical primary combustion chamber outer wall 142 provided contiguous at one end thereof on the upstream side to the wall surface formed of water cooling pipes 158 and loosely extending at the other and thereof into the burner throat 143 and facing the furnace.

A secondary combustion chamber 240 is formed on the downstream side of the primary combustion chamber 157, with the secondary combustion chamber 240 being continuous on the upstream side thereof to the primary combustion chamber 157, and opening on the downstream side thereof to the furnace 112. A wall of the secondary combustion chamber 240, which connects an axial end portion thereof opened to the primary combustion chamber 157 and the other axial end portion thereof opening to the furnace 112, is provided with the burner throat 143 and an annular auxiliary mixture passage 238 defined between a nozzle 237 forming an inner surface of the burner throat 143 and a nozzle 236 having the end portion of the primary combustion chamber 142 closer to the furnace. The burner throat 143 and the auxiliary mixed gas passage 238 are provided such that the cross section of the secondary combustion chamber 240, which is perpendicular to the axis of the burner, increases towards the furnace.

The auxiliary mixture passage 238 is opened at one end thereof to the secondary combustion chamber 240, with an opposite end communicating with air supply ducts 122*a* and 122*b* through the damper 232 and the window box 173. Discs 160 and 235 are respectively provided at outer peripheries of the nozzles 236, 237. A plurality of resistor type swirl vanes 162 are mounted in an annular space defined between the disks 160 and 235, with each vane being integrally provided with a support post 161. The post 161 is mounted with a longitudinal axis thereof parallel with the generating line of a cylinder constituting the primary combustion chamber 142, and the opposite ends of the pots 161 are rotatably mounted in bearing holes formed in the discs 160 and 235. A plurality of fuel injection holes 251 are provided in a downstream-side end face of the rotary vane 162. The holes 251 are connected to a fuel reservoir to which gaseous fuel is supplied, through a gas reservoir 225 in the vane 162, and a supply pipe passing through the central part of either one of the support posts 161 on the furnace side and the side closer to the burner side wall 147 and also through a communicating pipe 234. The damper 232 is attached integrally to the upstream side ends of the discs 160 and 235. Attached to the upstream side of damper 232 is a movable damper 231 integrally formed with a control rod 230 passing through the burner side wall. The damper 232 and the movable damper 231 each has a plurality of circular apertures. As the movable damper 231 is moved by the control rod 230 in the direction of the generating line of the primary combustion chamber outer wall 142, the area of the apertures projected in the downstream direction is controlled. When the apertures of the movable damper 231 coincide with the apertures of the damper 232, the area of the apertures is maximum, so that the air flow rate into the auxiliary mixture passage. Conversely, when the dampers 231 and 232 are controlled so that the apertures of the movable damper 231 do not coincide with the apertures of the damper 237, the area of the aperture is minimum, so that the air flow rate into the auxiliary mixture passage is minimum. Description has been made to the movable damper 231 which has a plurality of apertures, but it is also possible to achieve the same object by use of a movable damper 231 which is fashioned as an imperforate disc plate.

The main mixture passage for forming a main flame is provided on the inner periphery of the stabilizer plate 155 for forming a pilot flame. The main mixture passage is an annular passage defined by a primary throat 210 and a premixture throat 140 provided to surround the outer periphery of the primary throat 210. The upstream side of the primary throat 21 is connected to a nozzle 208 having an arcuate cross section. The upstream side of the premixture throat 140 is connected to a nozzle 209 having an arcuate cross section. The end face of the upstream side of the nozzle 208 is connected to the burner side wall, while the end face of the upstream side of the nozzle 209 is connected to a premixture side wall 211 provided on a side of the burner side wall 147 which is closer to the furnace. A plurality of resistor type swirl vanes 206 are mounted in an annular space defined by the burner side wall 147 and the premixture side wall 211. Each vane is integrally provided with a support post 207 mounted with a longitudinal axis thereof parallel with the generating line of a cylinder forming the primary combustion chamber outer wall 142, with the opposite end of the post 207 being rotatably mounted in bearing holes formed in the burner side wall 147 and the premixture side wall 211. The post 207 is mounted to the vane 206 near the downstream side thereof. Therefore, even if the inclination angle of the vane 206 is increased to increase the swirl strength, it does not occur that the adjacent vanes contact one another and the opening area of the outlet of the vane is decreased. The upstream side end face of the premixture side wall 211 is connected to one end of a damper 205 disposed concentrically with the primary combustion chamber outer wall 142. The other end of the damper 205 is connected to the burner side wall 147. A movable damper 204 integrally formed with a control rod 203 is provided around the outer periphery of the damper 205. The damper 205 and the movable damper 204 have a similar construction and operation to the damper 231 and the movable damper 232.

A plurality of fuel pipes 201 passing through the nozzle 208 are provided on a downstream side of the vanes. An injection hole 202 is provided on a side of each fuel pipe which is nearer to the furnace, with the injection hole 202 opened at downstream side thereof to the main mixture passage. The injection hole 202 is connected at upstream side thereof to a fuel pipe 179 through the fuel pipes 201 and a fuel reservoir 200 connected to the plurality of fuel pipes 201.

The primary throat 210 holds a cylinder 215 at the inner periphery thereof, with a speed control valve 216 being connected to the furnace side of the cylinder 215. The valve 216, at the upstream side thereof, has a diameter equal to the diameter of the cylinder 215 and the diameter of the valve 216 increases in a direction towards the furnace. The valve 216 is mounted so as to be movable in the direction of the generating line of the primary combustion chamber outer wall 142 by the primary throat 210, the cylinder 215, and a blind plate 213 attached to the nozzle 208 and having in the center thereof a guide for a flow speed control rod 214. The flow speed control rod 214 is integrally connected with the cylinder 215 and controls the flow velocity control valve 216. When the valve 16 is moved to the upstream side (the state as indicated by the solid line in Fig, 20), the passage area of the main mixture passage 212 facing the primary combustion chamber 157 is minimized. The flow velocity control valve 216, when moved to the downstream side (the state indicated by the broken line in FIG. 20), maximizes the passage area of the main mixture passage 212 facing the primary combustion chamber 157. The flow speed control valve 216 operates according to the quantity of mixture supplied to the main premixture passage 212 to control the passage area of the main premixture passage, which is nearer to the primary combustion chamber 157. For example, it is possible for the speed of the premixture injected from the main premixture passage 212 to be generally constant, regardless of the supply flow rate of the premixture. Therefore, it is possible to prevent the flame from withdrawing into the main mixture passage under a combustion condition with low load and reduced supply of premixture. The volume flow rate of air varies according to the preheating temperature. If the flow speed control valve 216 operates so that the cubic expansion can be compensated by measurement of a preheating temperature of air, the outlet speed of the main mixture can be maintained constant regardless of the preheating temperature. Also, by attaching a flame holder to the flow speed control valve 216, the main combustion flame can be made more stable.

By moving the control rods 203 and 230, the relative position of the movable damper 204 and the damper 231 is changed, so that the area of aperture obtained by mutual overlapping of the movable damper 204 and the damper 231 is changed accordingly. More specifically, as the movable damper 204 changes its position, it changes the area of the apertures, thereby controlling the quantity of air flowing into the main mixture passage 212 or the auxiliary mixture passage 238. Since the pressure loss in the vanes occurs when the inclination angle of the vane 206 or 162 is changed, the incoming air flow rate varies according to the swirl strength, By changing the area of the apertures so that the pressure loss between the movable damper inlet and the swirl vane outlet is constant, the incoming air flow rate can be maintained constant regardless of the swirl strength.

The fuel supplied from the fuel reservoir 233 flows through the communicating pipe 234, the support post 161 and the gas reservoir 252 held within the vane 162, and is injected from a plurality of fuel injection holes 251 provided at the downstream side end face of the vane 162. The injected fuel is mixed with air fed to the auxiliary mixture passage 238, thus forming premixture, which becomes an auxiliary combustion flame. The method of injecting gaseous fuel from the fuel injection holes 251 of the vane 162 can shorten the time necessary for mixing of the air and the gaseous fuel, as compared with the method of mixing the gaseous fuel in the air, which fuel is injected from the fuel pipe 201 extending into the passage. Therefore, the auxiliary mixture passage can be shorter than the main mixture passage. This is because a swirl 254 formed after the swirl vane has a greater intensity of turbulence than that of the downstream side of the fuel pipe 202. The injected gaseous fuel is drawn into the swirl 254 and when mixed completely with the air by small swirls generated by the swirl 254. The mixing of gaseous fuel and air is further promoted in case that the intensity of turbulence is increased by providing protrusions on the surfaces of the vane. Furthermore, according to the method of injecting gaseous fuel from the vane, since no obstacles are provided on the downstream side of the vane, the swirl flow formed by the vane is not damped by obstacles. Fuel is separately supplied to form d main combustion flame and an auxiliary combustion flame. When a combustion load is small and the fuel supply rate is low, the boiler cuts off a supply of fuel to the auxiliary mixture passage.

The stabilizer plate 155 injects a premixture of an air ratio of 1 and, preferably, 1.0 to 1.5, at a few meters per second, preferably, 1 to 3 m/s, into the primary combustion chamber 157 to form a pilot flame of the premixture. The main combustion mixture passage injects premixture of an air ratio of 1 or less, preferably, 0.5 to 0.9 at 20 to 30 m/s, in a swirl flow manner into the primary combustion chamber 157, which is ignited by the pilot flame to form the main combustion flame. The auxiliary combustion mixture passage injects premixture of an air ratio of 1 or more, preferably, 1.0 to 1.5 at the 20 to 50 m/s, in a swirl flow manner into the secondary combustion chamber 240, which is ignited by the main combustion flame to form the auxiliary combustion flame. Since the air ratio of the premixture forming the main combustion flame is 1 or less, the maximum temperature of the flame is lower than the conventional diffusion flame, so that the production of thermal NOx is restrained. At the same time, the thermal NOx produced by combustion is subjected to vapor-phase reduction by intermediate products of the gaseous fuel and reduced to nitrogen. The intermediate products by the main combustion flame vapor-phase reduce the thermal NOx produced by the auxiliary combustion flame into nitrogen. The vapor-phase reduction of the NOx produced by the auxiliary combustion flame due to the main combustion flame is promoted by providing the primary combustion chamber with an angled portion so as to permit the mixture from the auxiliary mixture passage collide into the main combustion flame. Since the cross section of the secondary combustion chamber in the flow direction increases in a direction towards the furnace, there is no rise in speed in the secondary combustion chamber where the main combustion flame and the auxiliary combustion flame are formed.

With regard to the pilot flame, description has been made to a case where it is formed by premixture. The object of the pilot flame lies in igniting the main combustion mixture to form a main combustion flame, Therefore, the method of forming a flame by injecting a small quantity of fuel into the primary combustion chamber and air into the fuel from around thereof, that is to say, the method of forming a pilot flame by the diffusion flame does not deviate from the object of the present invention.

While the above-description relates to the burner construction wherein the gaseous fuel is divided into three portions, which are separately supplied to form a pilot flame, a main combustion frame and an auxiliary combustion flame, and the ignition successively occurs by the flames in the above-mentioned order it is also possible for the gaseous fuel to be divided into more than three portions.

The radiant heat transfer pipe **115*b* abuts the furnace 112 and the flue 114*a*, while the radiant heat transfer pipe 115*c* abuts the furnace 112 and the flue 114*b*. The surface temperature of the sides of the radiant heat transfer pipes 115*b* and 115*c* nearer to the flues 114*a*, 114*b* becomes substantially equal to the exhaust gas temperature in the flues 114*a*, 114*b***. Therefore, the heat quantity escaping to the outside from the sides of the radiant heat transfer pipes spaced from the furnace is reduced as compared with the conventional techniques in which the sides of the radiant heat transfer pipes spaced from the furnace covered by heat insulators. Thus, in the present embodiment, the thermal efficiency of the boiler is improved.

Since a plurality of the convection heat transfer pipes 119 are not disposed in parallel with the flow direction of the combustion gas, the flow near the surface of the convection heat transfer pipes 119 is maintained in a turbulent state, whereby the heat transfer rate is increased. Also, it has become possible to secure a heat transfer area necessary for a boiler with an evaporation rate of several tons/h to several hundred tons/h in a limited furnace volume.

The steam, heated as it flows through the steam heat transfer pipes 117, flows into the steam reservoir 129 in which the steam is heat-transferred with the water in the steam drum 128 through the pipe wall of the steam reservoir 129 placed in the water of the steam drum 128. The steam heats the water in the steam drum and is condensed into the condensate. Then, the condensate flows back to the water reservoir 133 through a return pipe (not shown). The condensate from the water reservoir 133 is heated to evaporate the same while passing through the steam generating pipe 116*a* or 116*b*, and is further heated to steam by the flame in the radiant heat transfer pipe 116*c* and the steam heat transfer pipes 117, or in the radiant heat transfer pipe 116*d* and the steam heat transfer pipes 117. The steam then flows into the steam reservoir 129 incorporated within the steam drum 128, where the steam transfers the heat to the water held in the steam drum 128. By this process, a heat transfer of 45,000 to 60,000 kcal/$m^2$h is obtained which is 1.5 to 2 times higher than the conventional method by a combination of movement and condensation of heat transfer medium without a damage of the heat transfer pipes or burning loss thereof due to contact with the flame.

The superheaters 118 installed in the heating passages 170 prevent combustion gas from deviating and breaking away the combustion gas from a wall surface of the bent passages of the heating passages 170, and uniformalize the velocity of the combustion exhaust gas at the inlet of the flues 114, thereby improving the heat exchange efficiency in the flues 114. Further, there are no heat transfer pipes having locally high heat absorption so that damage to the pipes such as burning loss is prevented.

The second air preheater 124 provided at the uppermost side of the upper flue 114*d* receives the air with its incoming flow rate controlled by the opening adjustment of the heating control valves 125. In this manner, the heat quantity is controlled which is deprived of the combustion exhaust gas in the second air preheater 124. As a result, the temperature of the combustion exhaust gas flowing into the gas combustor 126 is maintained in the range which is set according to the active temperature of the catalyst used is the gas combustor 126. As described of, by controlling the quantity of air flow into the second air preheater 124 the combustion exhaust gas temperature at the inlet of the gas combustor 126 can be maintained in the set temperature range even if the boiler load changes. The second air preheater 124 is located against the upstream side of the gas combustor 126. The combustor exhaust gas is rectified as it passes through the flue of the second air preheater 124 and flows into the gas combustor 126.

The gas combustor 126 can reduce the concentration of carbon monoxide which is the uncombusted gas in the combustion exhaust gas by controlling the time duration of contact between the combustion exhaust gas and the catalyst. When the contact time duration is set 0.1 to 1 second, the carbon monoxide concentration could be reduced from several thousands ppm to 100 ppm or less. The gas combustor 126 may combusts a small amount of gaseous fuel in the exhaust gas to generate a high temperature gas which is brought into contact with carbon monoxide to oxidize the carbon monoxide into carbon dioxide. However, in this case, it is necessary to hold the exhaust gas in the gas combustor a time period of 1 to 2 seconds. Therefore, a length of the gas combustor 126 is increased, which is not desirable from a view point of reduction in size Of the boiler.

Figure 19:
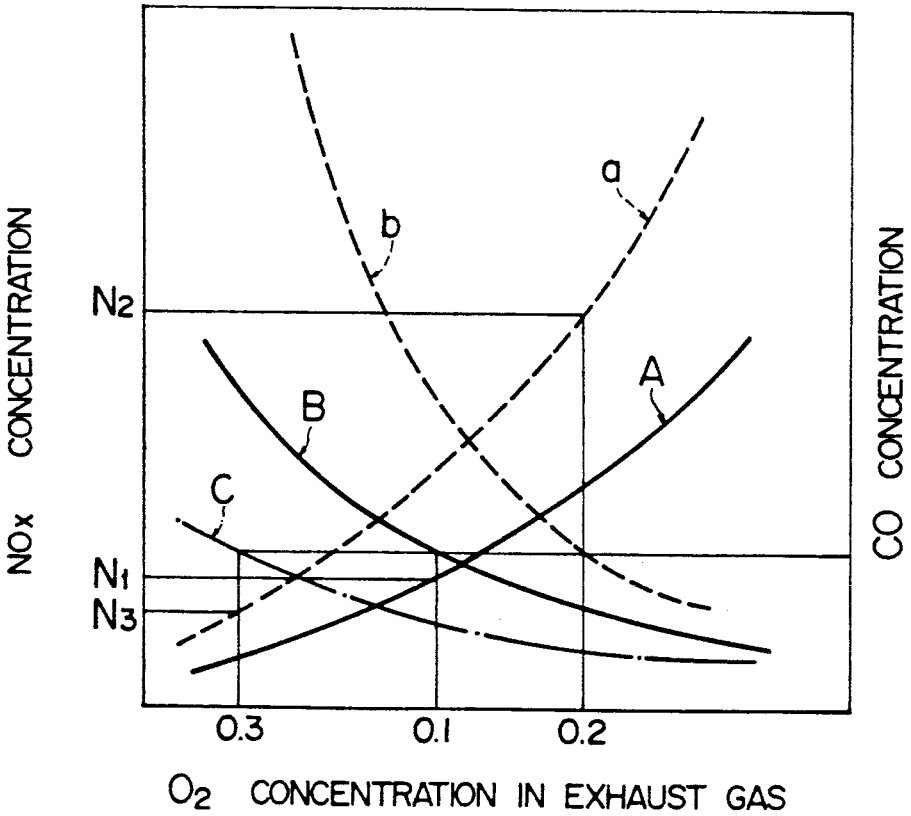
FIG. 19 is a graphical illustration of the relationship between concentrations of NOx, CO and $O_2$ in exhaust gas.
Figure 20:
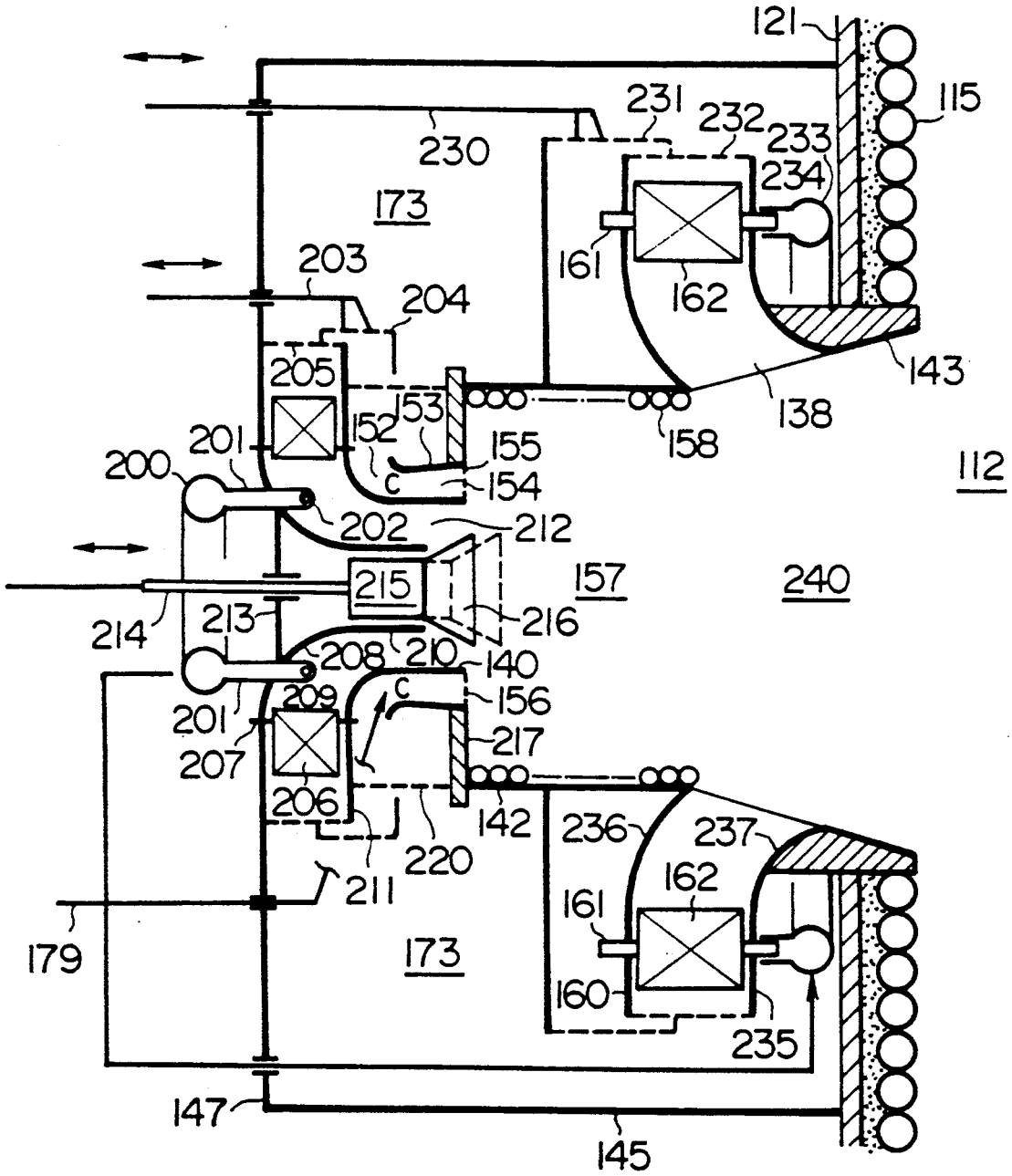
FIG. 20 is a schematic detail view of the burner of FIG. 15.

FIG. 19 is a characteristic diagram showing relations between the concentration of oxygen and those of NOx and carbon monoxide contained in the combustion exhaust ga at the outlet of the boiler. The solid lines indicate the characteristics of the conventional boiler and the broken lines indicate the characteristics of the conventional boiler when its furnace volume is changed to raise the combustion load to a level equal to that of the invention. In both cases, the same burner is used. When the combustion load of the conventional boiler is raised, the gas temperature in the furnace increases to increase the thermal NOx. The broken line A representing the NOx concentration when the combustion load is increased is higher than the solid line A representing the NOx concentration when the combustion load is not increased. In brief, the NOx concentration is higher in the former at the same $O_2$ concentration. On the other hand, as the combustion load increases, the gas residence time in the furnace becomes shorter and then the duration of contact between the gaseous fuel and the high-temperature gas also becomes shorter, Therefore, in regard to the concentration of uncombusted contents, particularly of carbon monoxide, the broken line b representing CO concentration when the combustion load is increased is higher than the solid line B representing CO concentration when the combustion load is not increased. In brief, the CO concentration is higher when the combustion load is increased if the $O_2$ concentration is the same.

With the combustor 126 of the present invention, the CO concentration in the exhaust gas is decreased as indicated by the dashed line C, and therefore, the $O_2$ concentration is low which is required to obtain the same CO concentration at the levels indicated by the solid line B and the broken line b. If the $O_2$ concentration is set 0.3, the NOx concentration N3 becomes lower than the NOx concentration N1 of the conventional boiler under the same CO concentration, and than the NOx concentration N2 of the conventional boiler of high-load combustion, as well. The provision of an gas combustor 126 enables low-oxygen operation with $O_2$ concentration lower than any other conventional boilers, and then reduces NOx. In addition, the discharged quantity of carbon monoxide is increased by reduction of excess air to be supplied to the furnace. Such carbon monoxide can be reduced by the gas combustor 126. Therefore, the furnace size can be reduced since it is unnecessary to increase the furnace size to reduce the quantity of carbon monoxide produced in the furnace.

The premixture throat 140 injects the premixture of an air ratio of 1 or less, preferably, 0.5 to 0.9, in a swirl flow manner at 20 to 50 m/s, into the primary combustion chamber 157. The injected premixture is ignited by the pilot flame to form the main combustion flame. Since the air ratio of the premixture forming the main combustion flame is 1 or less, the thermal NOx produced by combustion is reduced through vapor-phase reduction by the combustion intermediate products of the gaseous fuel into nitrogen. Thus, the NOx concentration at the same $O_2$ concentration is made lower than that shown by the broken line b in FIG. 19. The main combustion flame is due to the premixture combustion and then has a combustion speed faster than the diffusion flame, the combustion velocity of which is controlled by mixing. Therefore, it can be possible to shorten the flame length. The primary combustion chamber 157 secures a combustion zone in which the main combustion flame is combusted at the air ratio of 1 or less. It prevents an unstable combustion of the pilot flame and the main combustion flame which is caused by combustion air from the combustion air passage 238. In order to prevent the unstable combustion, the primary combustion chamber 157 is so designed that the ratio of l /d, i.e. the length l to the inner diameter d, is set 0.2 to 2, preferably 0.3 to 0.9.

The above-mentioned boiler is started up by supplying a predetermined quantity of air into the premix chamber 177 and a gaseous fuel to the fuel nozzle 152 to form a pilot flame at an air ratio to about 1.2, and thereafter by increasing the quantities of air and fuel to be supplied to the main premixture passage 212 while maintaining the air ratio of about 0.6, thereby setting the combustion load at a predetermined value.

According to the present invention, the stability of the premixture flame can be improved by making it easier for the combustion of the premixture to progress from the central portion of the flow of the premixture by the action of a plate disposed downstream of the premixture injection outlet not parallel with the direction of the mainstream of the injected premixture.

NOx from the premixture flame can be greatly reduced at the excess air ratio of about 1.0 by mixing a part of the combustion gas into the mixture at the outer periphery of the mixture flow before the mixture starts to burn. By embodying premixture combustion system boiler according to the present invention, a high-load, low-NOx boiler can be realized because the quantity of NOx produced at the same excess air ratio does not change even when the combustion load is increased. Furthermore, by installing a plurality of premixture nozzles and diffusion combustion burners to each premixture nozzle for stabilizing the flame, the boiler load can be stably changed from 10% to 100%.

Incidentally, a primary combustion chamber is provided in the burner, in which combustion chamber the combustion is effected with a low air ratio of 0.5 to 0.9. The uncombusted gas produced from the primary combustion chamber is completely combusted by residual oxygen from the secondary nozzle. In this manner, high-loading low-NOx combustion can be realized by a single burner.

A boiler according to the present invention combusts the uncombusted gas in the combustion gas in the middle of the exhaust gas duct, and therefore, the discharge of the uncombusted gas can be greatly reduced. Thus, NOx combustion can be reduced.

We claim:

1. A low-NOx boiler comprising:

a furnace;

a burner provided in said furnace for burning gaseous fuel, said burner having nozzle means for injecting a premixture of gaseous fuel and combustion air, and flame holding means located near a downstream side of said nozzle means to interrupt a flow of said premixture to form a circulating flow on a downstream side of said flame holding thereby forming swirls of combustion gas inside and outside of a premixture flame;

heat transfer pipe means for heating water by combustion heat of said burner to generate steam, said heat transfer pipe means being located in said furnace and having a passage through which water flows;

the steam drum means communicating with said heat transfer pipe means and accumulating therein said steam from said heat transfer pipe means;

exhaust gas duct means located in said furnace for exhausting combustion gas generated by combustion of the gaseous fuel outside of said boiler; and uncombusted gas combusting means located in said exhaust gas duct for combusting an uncombusted content in said combustion gas flowing in said exhaust gas duct means.

2. A furnace low-NOx boiler comprising:

a furnace;

a burner provided in said furnace for burning gaseous fuel, said burner having nozzle means for injecting a mixture of gaseous fuel and combustion air in a straight flow, rectifying means located in said nozzle means and having a plurality of through-holes through which said mixture flows to be rectified, and flame holding means located near said nozzle means to interrupt said mixture flow to form a circulating flow on a downstream side of said flame holding means;

heat transfer pipe means for heating water by combustion heat of said burner to generate steam, said heat transfer pipe means being located in said furnace and having a passage through which water flows;

steam drum means communicating with said heat transfer pipe means and accumulating therein said steam from said heat transfer pipe means;

exhaust gas duct means located in said furnace for exhausting combustion gas generated by combustion of the gaseous fuel outside of said boiler; and uncombusted gas combustor means located in said exhaust gas duct means for combusting an uncombusted content in said combustion gas flowing in said exhaust gas duct means.

3. A low-NOx boiler comprising:

a furnace;

a burner provided in said furnace for burning gaseous fuel, said burner having a nozzle means for injecting a premixture flow of gaseous fuel and combustion air, and flame holding means having an area less than a cross-sectional area of said nozzle means and located near a downstream side of said nozzle means to interrupt said premixture flow to form a circulating flow on a downstream side of said flame holding means thereby forming swirls of combustion gas inside and outside of a premixing flame;

heat transfer pipe means for heating water by combustion heat of said burner to generate steam, said heat transfer pipe means being located in said furnace and having a passage through which water flows;

steam drum means communicating with said heat transfer pipe means and accumulating therein said steam from said heat transfer pipe means;

exhaust gas duct means located in said furnace for exhausting combustion gas generated by combustion of the gaseous fuel outside of said boiler; and uncombusted gas combusting means located in said exhaust gas duct means for combusting an uncombusted content in said combustion gas flowing in said exhaust gas duct means.

4. A low-NOx boiler according to claim 3, wherein said flame holding means is a flat plate.

5. A low-NOx boiler according to claim 3, wherein said flame holding means is fashioned as a conical cylinder.

6. A low-NOx boiler comprising:

a furnace;

a burner provided in said furnace for burning gaseous fuel, said burner including a nozzle for injecting a premixture flow of gaseous fuel and air, and flame holding means located near said nozzle for interrupting said premixture flow to form a circulating flow on a downstream side of said flame holding means thereby forming swirls of combustion gas inside and outside of a premixture flame;

heat transfer pipe means for heating water by combustion heat of said burner to generate steam, said heat transfer pipe means being located in said furnace and having a passage through which water flows;

steam drum means communicating with said heat transfer pipe means and accumulating therein said steam from said heat transfer pipe means; and exhaust gas duct means located in said furnace for exhausting combustion gas generated by combustion of the gaseous fuel outside of said boiler.

7. A furnace low-NOx boiler comprising:

a furnace;

a burner provided in said furnace for burning gaseous fuel, said burner having nozzle means for injecting a mixture of gaseous fuel and combustion air in a straight flow, rectifying means located in said nozzle means for rectifying the straight flow of the mixture, and flame holding means located near said nozzle means to interrupt said mixture flow to form a circulating flow on a downstream side of said flame holding means;

heat transfer pipe means for heating water by combustion heat of said burner to generate steam, said heat transfer pipe means being located in said furnace and having a passage through which water flows;

steam drum means communicating with said transfer pipe means and accumulating therein said steam from said heat transfer pipe means;

exhaust gas duct means located in said furnace for exhausting combustion gas generated by combustion of the gaseous fuel outside of said boiler; and uncombusted gas combustor means located in said exhaust gas duct for combusting an uncombusted content in said combustion gas flowing in said exhaust gas duct means.

* * * * *